US006761219B2

(12) United States Patent
Snider et al.

(10) Patent No.: US 6,761,219 B2
(45) Date of Patent: Jul. 13, 2004

(54) CASING CONVEYED PERFORATING PROCESS AND APPARATUS

(75) Inventors: Philip M. Snider, Houston, TX (US); Eldon G. Williams, Jr., Katy, TX (US)

(73) Assignee: Marathon Oil Company, Findlay, OH (US)

( * ) Notice: Subject to any disclaimer, the term of this patent is extended or adjusted under 35 U.S.C. 154(b) by 0 days.

(21) Appl. No.: 10/144,903

(22) Filed: May 14, 2002

(65) Prior Publication Data

US 2002/0125011 A1 Sep. 12, 2002

Related U.S. Application Data

(63) Continuation of application No. 09/300,056, filed on Apr. 27, 1999, now Pat. No. 6,386,288.

(51) Int. Cl.[7] ..... E21B 43/11
(52) U.S. Cl. ..... 166/297; 166/55.1; 340/854.5
(58) Field of Search ..... 166/297, 55, 55.1, 166/250.01, 55.6; 340/854.5

(56) References Cited

U.S. PATENT DOCUMENTS

| | | | |
|---|---|---|---|
| 4,023,167 | A | 5/1977 | Wahlstrom |
| 4,572,293 | A | 2/1986 | Wilson et al. |
| 4,630,044 | A | 12/1986 | Polzer |
| 4,656,463 | A | 4/1987 | Anders et al. |
| 4,698,631 | A | 10/1987 | Kelly, Jr. et al. |
| 4,808,925 | A | 2/1989 | Baird |

(List continued on next page.)

FOREIGN PATENT DOCUMENTS

| | | | |
|---|---|---|---|
| EP | 0 013 494 | A1 | 7/1980 |
| EP | 0 412 535 | B1 | 2/1991 |
| EP | 0 651 132 | A2 | 5/1995 |
| EP | 0 730 083 | A2 | 9/1996 |
| SU | 1657627 | A1 * | 7/1989 |
| WO | WO 01/18357 | A2 | 3/2001 |
| WO | WO 01/73423 | A1 | 10/2001 |

OTHER PUBLICATIONS

Den–Con Tool Co., 1994–95 General Catalog, pp. 1–3.

*Primary Examiner*—David Bagnell
*Assistant Examiner*—Jennifer Dougherty
(74) *Attorney, Agent, or Firm*—Jack E. Ebel

(57) ABSTRACT

A process and apparatus for completing a subterranean well bore in at least one subterranean formation. At least one perforating gun assembly is positioned on the outside of casing in a subterranean well bore. A suitable signal, such as a hydraulic, electric or wave signal, is transported to the perforating gun assembly so as to detonate one or more explosive charges in the perforating gun assembly which are aimed toward the casing. At least one wall in the casing is perforated thereby establishing fluid communication through the wall of the casing. Usually, cement surrounding the casing and a subterranean formation surrounding the casing are also perforated to establish fluid communication between the formation and the interior of the casing. A logging tool may also be positioned exterior to the casing to aid in positioning the perforating gun assembly adjacent a subterranean formation of interest and pressure and/or temperature gauges may also be provided on the exterior of casing to monitor well bore and/or formation conditions. In one embodiment, multiple perforating gun assemblies are located outside casing and juxtaposed to multiple subterranean formations of interest. Thereafter, each perforating gun assembly may be selectively fired to perforate the casing and select formation. Zone isolation devices may be provided on the outside of the casing to permit each formation to be completed and stimulated and/or treated independent of the others. In this manner, multiple subterranean formations may be completed and stimulated and/or treated more efficiently and cost effectively.

5 Claims, 34 Drawing Sheets

U.S. PATENT DOCUMENTS 4,827,395 A 5/1989 Anders et al.
5,105,742 A 4/1992 Sumner
5,142,128 A 8/1992 Perkin et al.
5,202,680 A 4/1993 Savage
5,279,366 A 1/1994 Scholes
5,361,838 A 11/1994 Kilgore
5,457,447 A 10/1995 Ghaem et al.
5,467,823 A * 11/1995 Babour et al. ..... 166/250.01
5,479,860 A 1/1996 Ellis
5,495,237 A 2/1996 Yuasa et al.
5,497,140 A 3/1996 Tuttle
5,505,134 A 4/1996 Brooks et al.
5,608,199 A 3/1997 Clouse et al.
5,626,192 A 5/1997 Connell et al.
5,654,693 A 8/1997 Cocita
5,680,459 A 10/1997 Hook et al.
5,682,143 A 10/1997 Brady et al.
5,720,345 A 2/1998 Price et al.
5,829,538 A 11/1998 Wesson et al.
5,911,277 A 6/1999 Hromas et al.
6,018,501 A 1/2000 Smith et al.
6,025,780 A 2/2000 Bowers et al.
6,070,662 A * 6/2000 Ciglenec et al. ..... 166/254.1
6,078,259 A 6/2000 Brady et al.
6,135,206 A 10/2000 Gano et al.
6,151,961 A 11/2000 Huber et al.
6,257,338 B1 7/2001 Kilgore
6,333,700 B1 12/2001 Thomeer et al.
6,343,649 B1 2/2002 Beck et al.
6,538,576 B1 * 3/2003 Schultz et al. ..... 340/854.6
2001/0013410 A1 8/2001 Beck et al.
2001/0013411 A1 8/2001 Beck et al.
2001/0042617 A1 11/2001 Beck et al.
2001/0043146 A1 11/2001 Bect et al.
2001/0054969 A1 12/2001 Thomeer et al.
2003/0098157 A1 5/2003 Hales et al.

* cited by examiner

CASING CONVEYED PERFORATING PROCESS AND APPARATUS

CROSS-REFERENCE TO RELATED APPLICATIONS

This application is a continuation of copending U.S. patent application Ser. No. 09/300,056, filed on Apr. 27, 1999 now U.S. Pat. No. 6,386,288.

This application is related to U.S. patent application Ser. No. 09/656,720, filed on Sep. 7, 2000 and entitled "Method and System for Performing a Casing Conveyed Perforating Process and Other Operations in Wells".

BACKGROUND OF THE INVENTION

1. Field of the Invention

The present invention relates to apparatus and processes for establishing communication through the wall of a well bore tubular, and more particularly, to apparatus and processes for completing a subterranean well, especially to complete a well in and stimulate multiple subterranean zone(s) and/or formations.

2. Description of Related Art

Once a subterranean well bore has been drilled by conventional techniques utilizing a drilling string which has a drill bit secured to one end thereof, the well bore is completed by positioning a casing string within the well bore to increase the integrity thereof and provide a path for producing fluids to the surface. The casing string is normally made up of individual lengths of relatively large diameter metal tubulars which are secured together by any suitable means, for example screw threads or welds. Conventionally, the casing string is cemented to the well bore face by circulating cement into the annulus which is defined between the casing string and the well bore. The cemented casing string is subsequently perforated to establish fluid communication between the subterranean formation and the interior of the casing string. Perforating is conventionally performed by means of a perforating gun which has at least one shaped charge positioned within a carrier, the firing of which is controlled from the surface of the earth. A perforating gun may be constructed to be of any length, although a gun to be conveyed on wireline is usually 30 feet or less in length. The perforating gun is lowered within the casing on wireline or tubing to a point adjacent the subterranean zone of interest and the shaped explosive charge(s) are detonated which in turn penetrate or perforate the casing and the formation. In this manner, fluid communication is established between the cased well bore and the subterranean zone(s) of interest. The resulting perforations extend through the casing and cement a short distance into the formation. The perforating gun is then removed from the well bore or dropped to the bottom thereof. The formation is often stimulated to enhance production of hydrocarbons therefrom by pumping fluid under pressure into the well and into the formation to induce hydraulic fracturing of the formation or by pumping fluid into the well and formation to treat or stimulate the formation. Thereafter, fluid may be produced from the formation through the casing string to the surface of the earth or injected from the surface through the casing string into the subterranean formation.

In some formations, it is desirable to conduct the perforating operations with the pressure in the well overbalanced with respect to the formation pressure. Under overbalanced conditions, the well pressure exceeds the pressure at which the formation will fracture, and hydraulic fracturing occurs in the vicinity of the perforations. The perforations may penetrate several inches into the formation, and the fracture network may extend several feet into the formation. Thus, an enlarged conduit can be created for fluid flow between the formation and the well, and well productivity may be significantly increased by deliberately inducing fractures at the perforations.

Frequently, a subterranean well penetrates multiple zones of the same subterranean formation and/or a plurality of formations of interest, which are hydrocarbon bearing. It is usually desirable to establish communication with each zone and/or formation of interest for injection and/or production of fluids. Conventionally, this is accomplished in any one of several ways. First, a single perforating gun may be conveyed on wireline or tubing into the subterranean well bore and fired to perforate a zone and/or formation of interest. This procedure is repeated for each zone to be treated. Alternately, a single perforating gun is conveyed on wireline or tubing into the subterranean well and the gun is positioned adjacent to each zone and/or formation of interest and selectively fired to perforate each zone and/or formation. In accordance with another approach, two or more perforating guns are positioned in a spaced apart manner on the same tubing, are conveyed into the well and fired. When the select firing method is used and the subterranean zone(s) and/or formation(s) of interest are relatively thin, e.g. 15 feet or less, the perforating gun is positioned adjacent the zone of interest and some of the shaped charges of the perforating gun are fired to selectively perforate only this zone or formation. The gun is then repositioned by means of the wireline to another zone or formation and certain shaped charges are fired to selectively perforate this zone or formation. This procedure is repeated until all zone(s) and/or formation(s) are perforated and the perforating gun is retrieved to the surface by means of the wireline. In the tubing conveyed, spaced gun approach, two or more perforating guns are conveyed into the well bore on the same tubing in a spaced apart manner such that each gun is positioned adjacent one of the subterranean zone(s) and/or formation(s) of interest. Once positioned in the well, the guns may be simultaneously or selectively fired to perforate the casing and establish communication with each such zone(s) and/or formation(s).

If the zone(s) and/or formation(s) which have been perforated by either conventional approach are to be hydraulically fractured, fluid is pumped into the well under pressure which exceeds the pressure at which the zone(s) and/or formation(s) will fracture. However, the fracturing fluid will preferential flow into those zone(s) and/or formation(s) which typically have the greatest porosity and/or the lowest pressure thereby often resulting in little or no fracturing of some of the zone(s) and/or formation(s). Further, considerable expense can be incurred in pumping fluid under sufficient pressure to fracture multiple zone(s) and/or formation (s) penetrated by a subterranean well bore. In an effort to rectify this problem, a procedure has been utilized wherein a perforating gun is lowered into a well on tubing or wireline adjacent the lowermost zone of interest and fired to perforate the casing and zone. Thereafter, the it is necessary to trip out of the well and remove the perforating gun to the surface. Fluid is then pumped into the well at sufficient pressure to fracture or stimulate the lowermost zone. The stimulation fluid may be recovered from the zone just perforated and fractured to inhibit any damage to the zone which may occur as a result of prolonged contact with the fracturing fluid. Prior to perforating and stimulating the next deepest zone of interest, a mechanical device or plug or sand fill is set in the well between the zone just fractured and the zone to be fractured to isolate the stimulated zone from further contact with fracturing fluid. This procedure is repeated until all zone(s) and/or formation(s) are perforated and fractured. Once this completion operation is finished, each plug must be drilled out of or otherwise remove the well to permit fluid to be produced to the surface through the well. However, the necessity of tripping in and out of the well bore to perforate and stimulate each of multiple zone(s) and/or formation(s) and the use of such plugs to isolate previously treated zone(s) and/or formation(s) from further treatment fluid contact is time consuming and expensive. In view of this, multiple zone(s) and/or formation(s) are often stimulated at the same time even though this results in unacceptable of treatment of certain zone(s) and/or formation(s). Thus, a need exists for apparatus and processes to perforate casing which is positioned within a subterranean well bore which eliminates the need to run perforating equipment in and out of the well when completing multiple zone(s) and/or formation(s).

Accordingly, it is an object of the present invention to provide a method and apparatus for economically and effectively perforating and stimulating multiple subterranean zone(s) and/or formation(s) which are penetrated by a subterranean well.

It is another object of the present invention to provide a process and apparatus for completing a subterranean well wherein casing is perforated to provide for fluid communication across the wall of the casing by means of a perforating gun assembly located in a subterranean well bore outside the casing.

It is a further object of the present invention to provide a process and apparatus wherein for completing and stimulating a cased, subterranean well bore wherein entry into the well bore to effectuate completion and/or stimulation is obviated.

It is still another object of the present invention to provide a process and apparatus for expeditiously treating and/or stimulating each subterranean formation penetrated by a subterranean well bore individually and therefore economically.

It is a still further object of the present invention to provide a process and apparatus for completing a subterranean well wherein multiple perforating gun assemblies are positioned in the well bore external to casing and adjacent to multiple subterranean formations of interest and selectively detonated to establish fluid communication between a subterranean formation and the interior of the casing.

SUMMARY OF THE INVENTION

To achieve the foregoing and other objects, and in accordance with the purposes of the present invention, as embodied and broadly described herein, one characterization of the present invention may comprise a process for establishing fluid communication. The process comprises positioning at least one explosive charge in a subterranean well bore such that the at least one explosive charge is placed external to casing which is also positioned within the well bore and is aimed toward the casing and detonating the at least one explosive charge so as to perforate the wall of the casing at least once.

In another characterization of the present invention, a process is provided for completing a subterranean well bore which comprises penetrating the wall of a casing which is positioned and cemented within a subterranean well bore from the exterior of the casing to the interior.

In yet another characterization of the present invention, a process is provided for completing a subterranean well which comprises positioning at least one explosive charge in a subterranean well bore outside of casing and detonating the at least one explosive charge so as to perforate the casing.

In yet another characterization of the present invention, a process is set forth for providing fluid communication across the wall of a casing. The process comprises detonating a first perforating gun assembly which is positioned outside of a casing in a subterranean well bore thereby perforating the casing.

In a further characterization of the present invention, a process is provided for completing one or more subterranean formations. The process comprises detonating a first perforating gun assembly which is positioned outside of a casing in a subterranean well bore thereby perforating the casing and a first subterranean formation.

In a still further characterization of the present invention, a process is provided for completing a subterranean well which comprises penetrating casing which is positioned in a subterranean well bore while the interior of the casing remains unoccupied by perforating guns or other equipment, tools, tubulars or lines.

In a still further characterization of the present invention, a subterranean completion system is provided which comprises a casing which is at least partially positioned within a subterranean well bore and at least one perforating gun assembly which is positioned external to the casing and within the well bore. The perforating gun assembly has at least one explosive charge aimed in the direction of the casing.

In a still further characterization of the present invention, a completion system is provided which comprises a casing and at least one perforating gun which is connected to the exterior of the casing and has at least one explosive charge aimed toward the casing.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE PREFERRED EMBODIMENTS

In accordance with the present invention, an assembly is provided for positioning within a subterranean well bore during completion thereof. The assembly comprises one or more perforating guns which are positioned adjacent the exterior of casing such that at least one explosive charge of the perforating gun is oriented to strike the casing. As utilized throughout this disclosure, the term "casing" refers to the tubulars, usually a string made up of individual joints of steel pipe, used in a well bore to seal off fluids from the well bore, to keep the walls of the well bore from sloughing off or caving in and through which fluids are produced from and/or injected into a subterranean formation or zone. The term "perforating gun" refers to an assembly for positioning in a subterranean well bore which contains one or more explosive charges which are ballistically connected to the surface and which are designed to penetrate the wall of casing.

Figure 1:
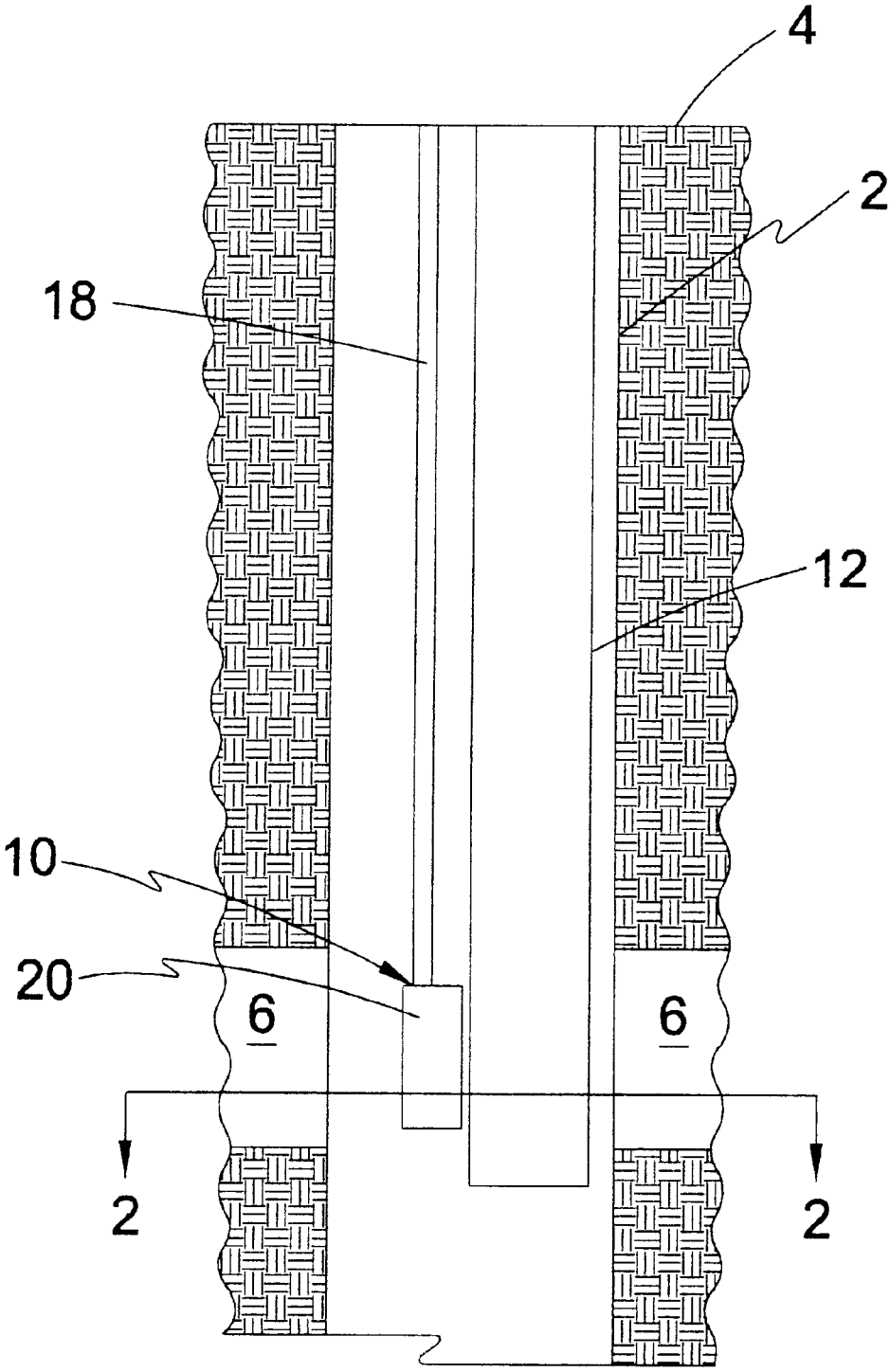
FIG. 1 is a sectional view of the assembly of the present invention as positioned within a subterranean well bore.
Figure 20:
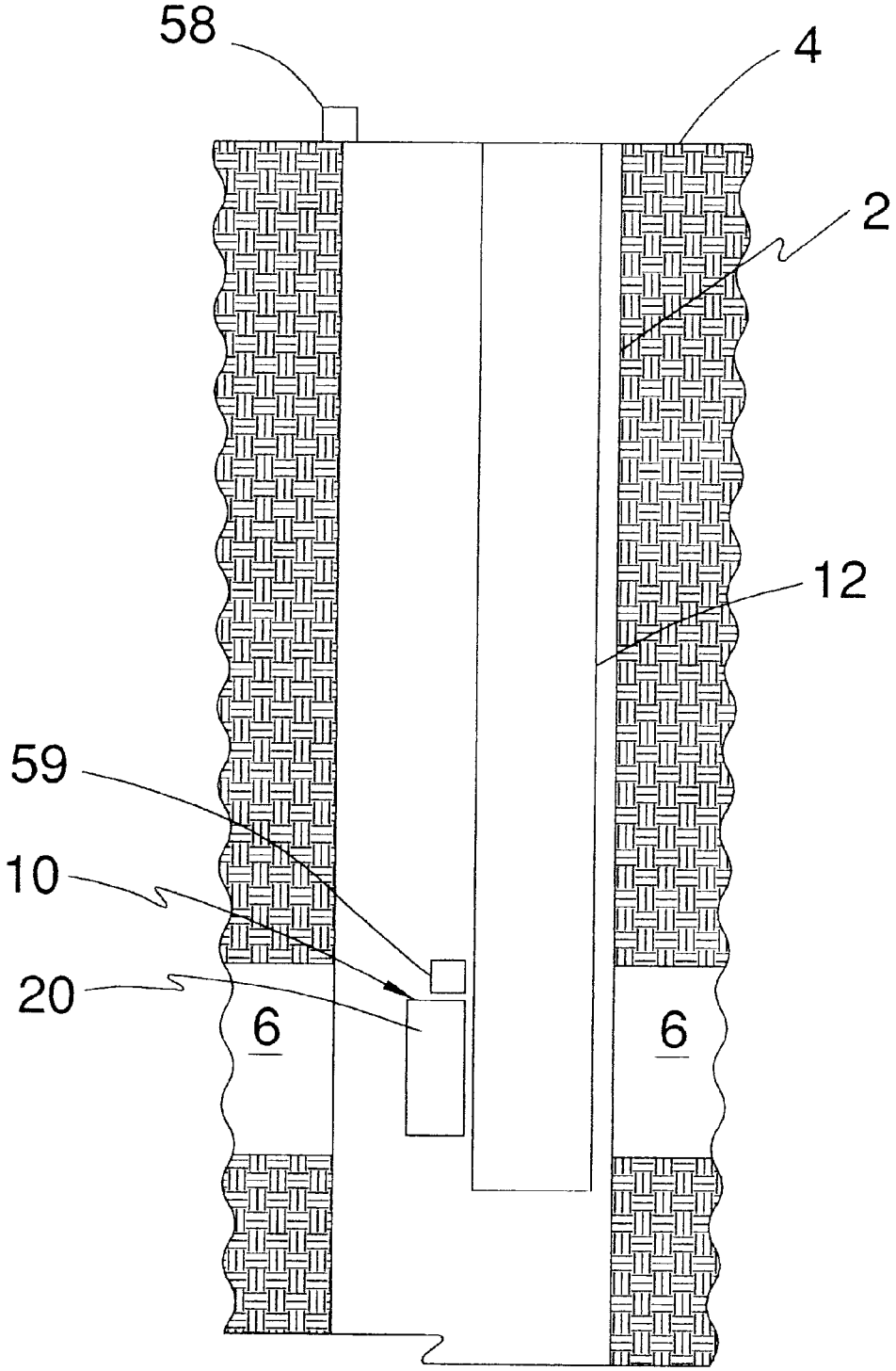
FIG. 20 is a sectional view of the assembly of the present invention as positioned within a subterranean well bore and utilizing electromagnetic or acoustic signaling and corresponding receivers.

Referring to FIG. 1, a subterranean well bore 2 is illustrated as extending from the surface of the earth or sea floor 4 and penetrating at least one subterranean formation 6. "Subterranean formation" as utilized throughout this disclosure refers to a subterranean formation, a layer of a subterranean formation and/or a zone of a layer of a subterranean formation which represents a given stratigraphic unit, such as a unit of porosity, permeability and/or hydrocarbon saturation. The assembly of the present invention is illustrated generally as 10 in FIG. 1 and comprises a perforating gun assembly 20 and casing 12. As assembled and positioned within well bore 2, the perforating gun assembly is positioned on the exterior of casing 12 adjacent the outer diameter thereof. Preferably, the perforating gun assembly 20 is secured to casing 12 by any suitable means, for example by metal bands, such as stainless steel bands, wrapped around both casing 12 and perforating gun assembly 20 or with specialty connections, to ensure that the relative position between perforating gun assembly 20 and casing 12, as fully assembled does not substantially change, either axially or rotationally, during positioning of the assembly of the present invention in well bore 2. The assembly of the present invention is preferably constructed either before and/or at the well site, i.e. either onshore location or offshore platform, at the surface 4 prior to running the assembly into well bore 2. As illustrated in FIG. 1, a control system 18, for example an electric line, extends from a suitable power source (not illustrated) at the surface 4 as will be evident to a skilled artisan to the perforating gun assembly 20 to provide an appropriate signal to ignite the perforating gun assembly. Where electric line is utilized, it is preferred that the line is armored for protection against damage during placement of the assembly in the well bore and that the line be secured to the casing by any suitable means, such as those described above with respect to securing the perforating gun assemblies. Other suitable control systems for igniting the explosive charge(s) contained in perforating gun assembly 20, such as hydraulic lines connected to a suitable source of pressurized hydraulic fluid (liquid or gas) or electromagnetic or acoustic signaling 58 and corresponding receivers 59 (FIG. 20) connected to the perforating gun assemblies for wave transmissions through the casing, soil and/or well bore fluids, may also be employed in the present invention. Any line or any other instrument mentioned below in conjunction with the assembly of the present invention should be secured to the casing at appropriate intervals to inhibit damage during positioning of the assembly in the well bore.

Figure 2:
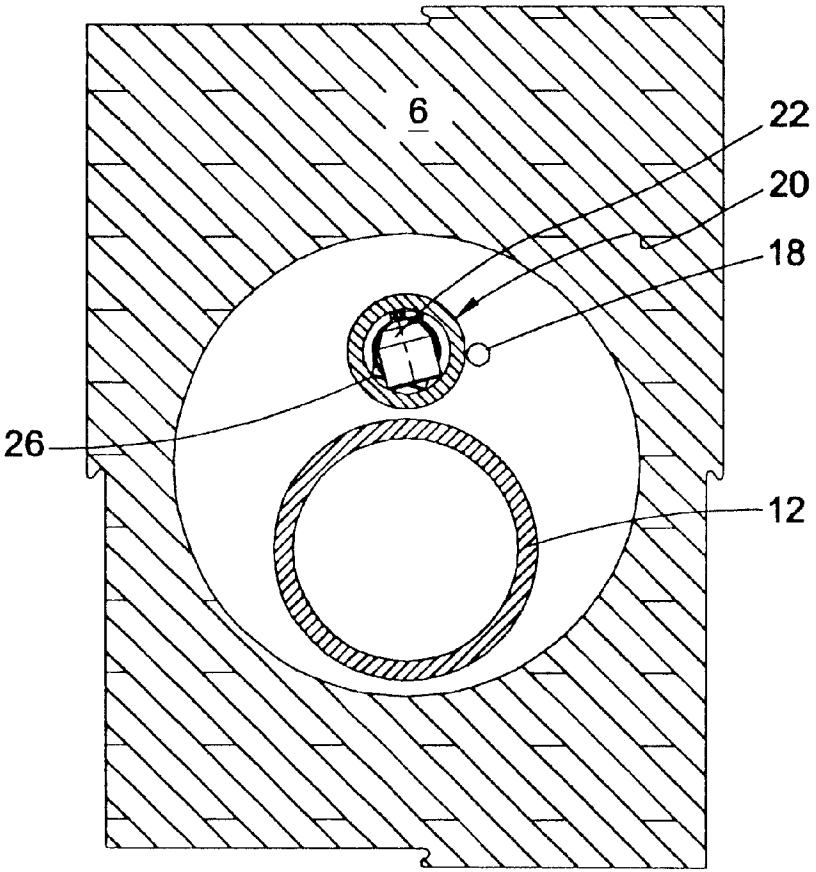
FIG. 2 is a cross sectional view of the assembly of the present invention as positioned within a subterranean well bore taken along the line 2—2 of FIG. 1.
Figure 3:
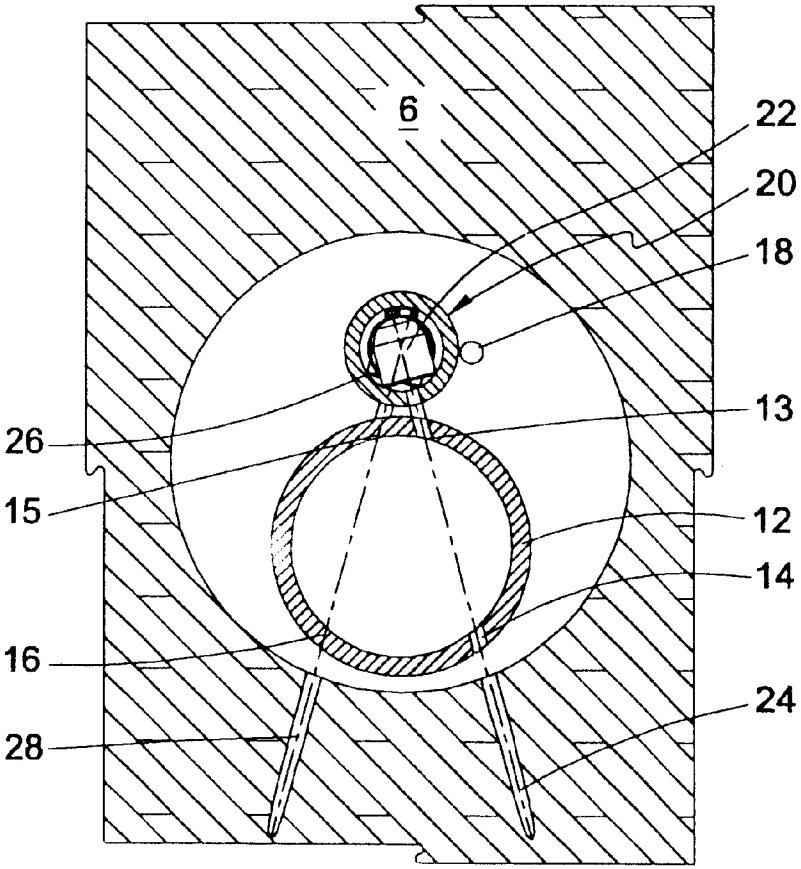
FIG. 3 is a cross sectional view of the assembly of the present invention as positioned within a subterranean well bore taken along the line 2—2 of FIG. 1 after at least one explosive charge of a perforating gun has been detonated.

Perorating gun assembly 20 has at least one explosive charge 22 contained therein which is aimed toward casing 12. As illustrated in FIG. 2, assembly 20 has two explosive charges 22, 26 which are axially spaced apart within assembly 20 and which, although oriented at slightly different angles, are both aimed toward casing 12. Upon transmission of a suitable signal, for example, electrical current via line 18, explosive charge 22 detonates and fires a shaped charge along path 24 creating perforations 13 and 14 in the wall of casing 12 while explosive charge 26 detonates and fires a shaped charge along path 28 creating perforations 15 and 16 in the wall of casing 12. It should be noted that although each charge is illustrated as being capable of creating two perforations in the wall of casing 12, these charges may be constructed so as just to punch a single perforation, for example 13 and 15, through the wall of casing 12 where desirable. For example, the assembly of the present invention may be employed wherever it is desirable to create fluid communication across the wall of casing, such as to monitor conditions within the interior of the well bore or to actuate a tool which is positioned on the outside of casing 12.

Figure 4:
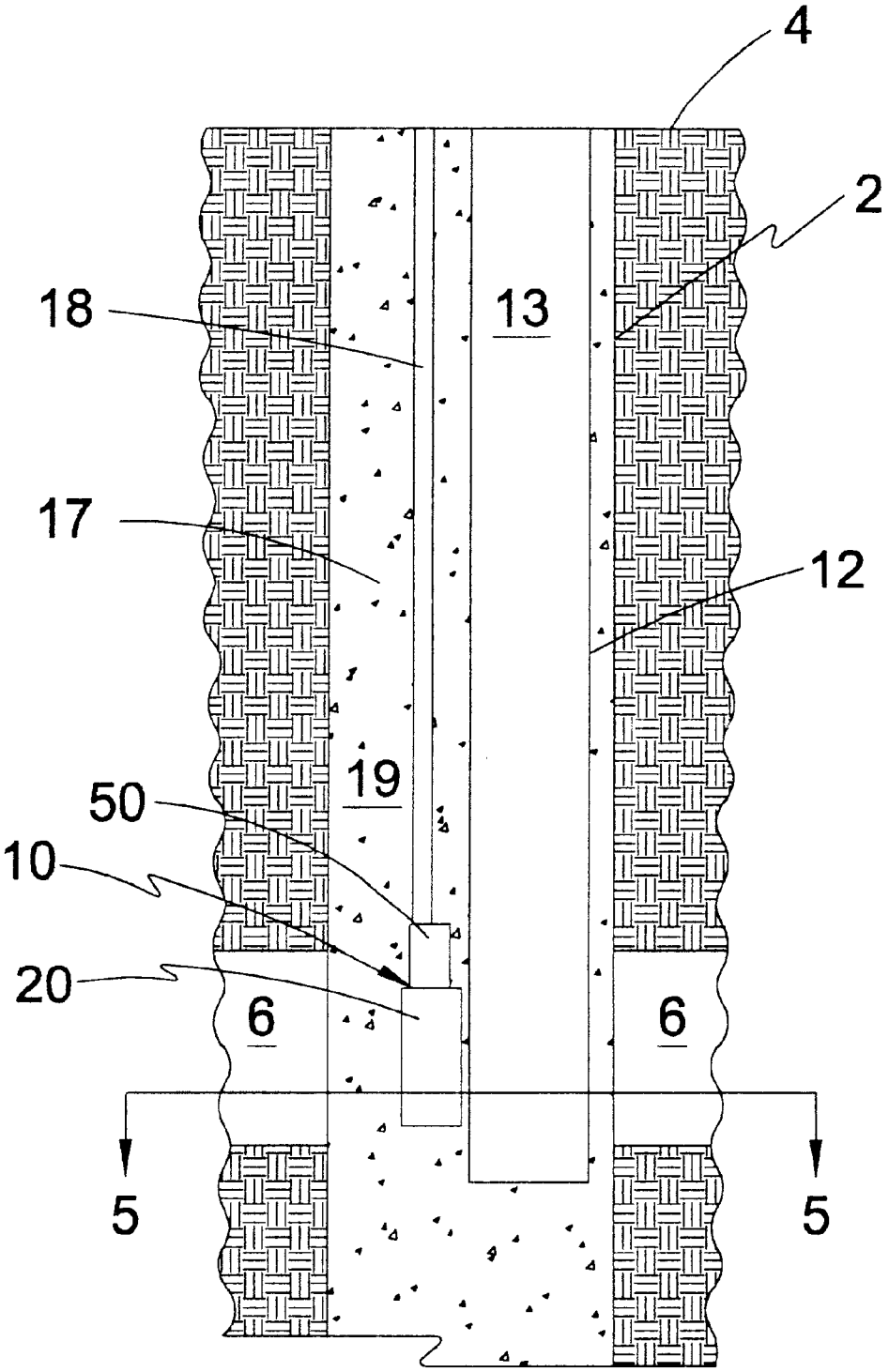
FIG. 4 is a cross sectional view of the assembly of the present invention as positioned and cemented within a subterranean well bore.

In one embodiment as illustrated in FIG. 4, the assembly of the present invention is positioned within a subterranean well bore after the well bore is drilled but prior to completing the well. Preferably, the assembly is positioned adjacent a subterranean formation of interest by any suitable means. The position of subterranean formation 6 will be known from open hole logs, such as gamma ray logs, which are run during or after a well bore is drilled and to a lesser extent by certain indications obtained during drilling, such as mud logs and/or changes in drilling penetration rates. As the assembly is being positioned within the well bore, a log may be obtained by extending a logging tool, such as a gamma ray tool, through casing 12 so as to align perforating assembly 20 with formation 6, or alternatively, by securing a logging tool 50 on the outside of casing 12 and adjacent the perforating gun assembly to obtain real time logs. By correlating these logs with open hole logs, the perforating gun assembly may be accurately positioned adjacent the subterranean formation 6 of interest. Often it is desirable to circulate fluid through the casing and the annulus defined between the casing and the well bore prior to cementing. As will be evident to a skilled artisan, the temperature of such fluid and of the cement during setting may cause the casing to contract or expand and such change should be taken into consideration during the initial placement of the assembly of the present invention in the well bore, especially where the formation of interest is relatively thin or short in length. Once the perforating gun assembly is properly positioned within the well bore, cement 17 is circulated either down through the interior 13 of casing 12 and back towards the surface via the annulus 19 formed between the casing and the well bore or, less preferably, down annulus 19 towards the bottom of the well bore. Prior to cement 17 being fully cured, casing 12 may be axially reciprocated to ensure that the cement is uniformly positioned about casing 12.

Figure 5:
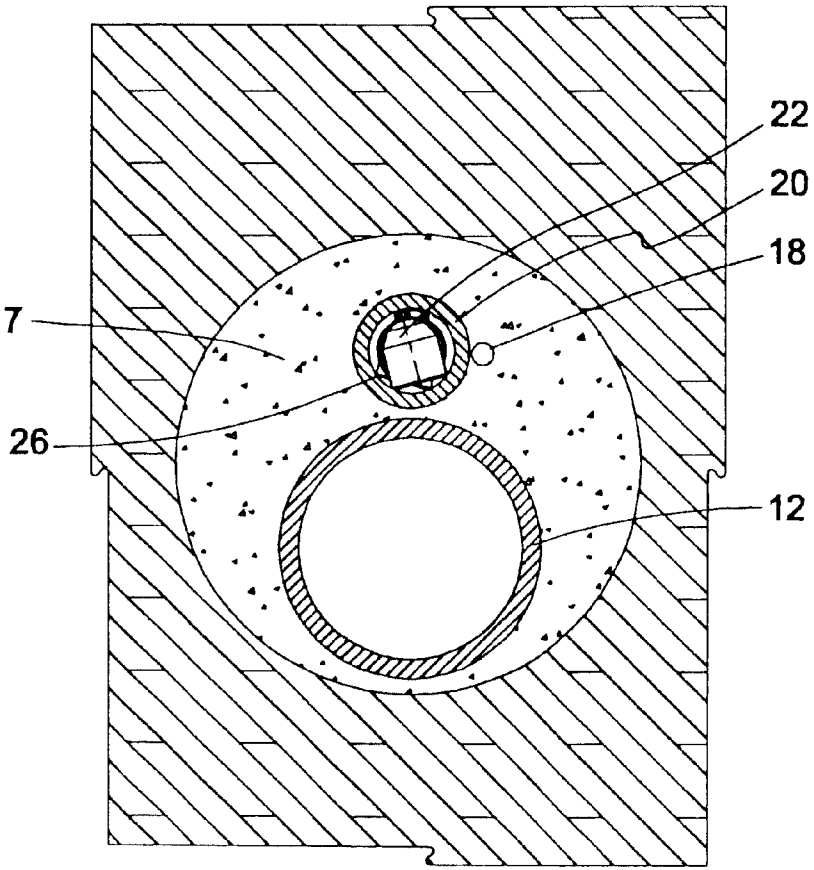
FIG. 5 is a cross sectional view of the assembly of the present invention as positioned and cemented within a subterranean well bore taken along the line 5—5 of FIG. 4.

In the manner just described, the assembly of the present invention is cemented in the well bore (FIG. 4) between the casing and the face of the well bore and is capable of being remotely actuated by any suitable means 18, such as electric line, hydraulic line, radio signals, etc. at a later time. Perforating gun assembly 20 has at least one explosive charge 22 contained therein which is aimed toward casing 12. As illustrated in FIG. 5, assembly 20 has two explosive charges 22, 26 which are axially spaced apart and which, although oriented at slightly different angles, are both aimed toward casing 12. Upon transmission of a suitable signal via means 18, for example electric current via an electric line, explosive charges 22 and 26 detonate. Upon detonation, explosive charge 22 fires a shaped charge along a path 24 thereby creating perforations 13 and 14 in the wall of casing 12 and a perforating tunnel 32 which extends through cement 17 and into subterranean formation 6, while explosive charge 26 fires a shaped charge along path 28 thereby creating perforations 15 and 16 in the wall of casing 12 and a perforating tunnel 34 which extends through cement 17 and into the subterranean formation 6. In this manner, fluid communication is established between formation 6 and the interior of casing 10. It should be noted that although each charge is illustrated as being capable of creating two perforations in the wall of casing 12, these charges may be constructed so as just to punch a single perforation, for example 13 and 15, through the wall of casing 12 where desirable. For example, it may be desirable to establish fluid communication between a separate tool (not illustrated), such as pressure gauge, which is located on the exterior of the casing adjacent and in fluid communication with the perforating assembly.

Thus, the process or method of the present invention broadly entails positioning a perforating gun assembly in a subterranean well bore outside of and juxtaposed to casing and detonating at least one explosive charge in the perforating gun assembly to penetrate the casing wall at least once. Preferably, the assembly of the present invention is cemented in the subterranean well bore and detonation of the explosive charge creates a perforation tunnel through the cement and into the subterranean formation. Even though each perforating gun assembly 20 may contain a multitude of explosive charges 30 as will be evident to a skilled artisan, it is only necessary to aim one such charge at casing 12 to practice the present invention. However, as a perforating gun assembly conventionally contains several explosive charges per foot, e.g. 6 (FIG. 7), it is usually desirable to have several charges in a given assembly aimed at the casing as run in a well bore. A preferred phasing pattern for six explosive charges in an assembly having at least six explosive charges is illustrated in FIG. 8. In this embodiment, the six charges 30 are axially and radially spaced in perforating gun assembly 20 in a spiral pattern. Three of the six charges are oriented to perforate casing 12 and create perforating tunnels 40, 42 and 44 upon detonation which extend through cement 17 into formation 6 while the remaining three charges are oriented so as to create perforating tunnels 46, 47 and 48 upon detonation penetrate the cement 17 and formation 6 but not casing 12. As illustrated in FIG. 8, the angle a between tunnels 40 and 42 and between tunnels 42 and 44 is substantially equal and will depend upon the diameter of the casing and perforating gun assembly and the spacing between the casing and assembly. For example, the angle a for a 2⅛" perforating gun assembly and 4½" casing is 30°, for a 2⅜" assembly and 3½" tubing is 22.5° and for a 2⅞" assembly and 2⅞" casing is 17.5°. Perforating tunnels 40, 42, 44 and 46–48 are formed by firing the explosive charges in sequence beginning from either end of the gun. Further, although it is preferred that the explosive charges of each assembly are oriented to shoot in a plane which is perpendicular to the axis of the assembly, one or more charges may be arranged to be shot at an angle with respect to the horizontal plane.

Figure 9:
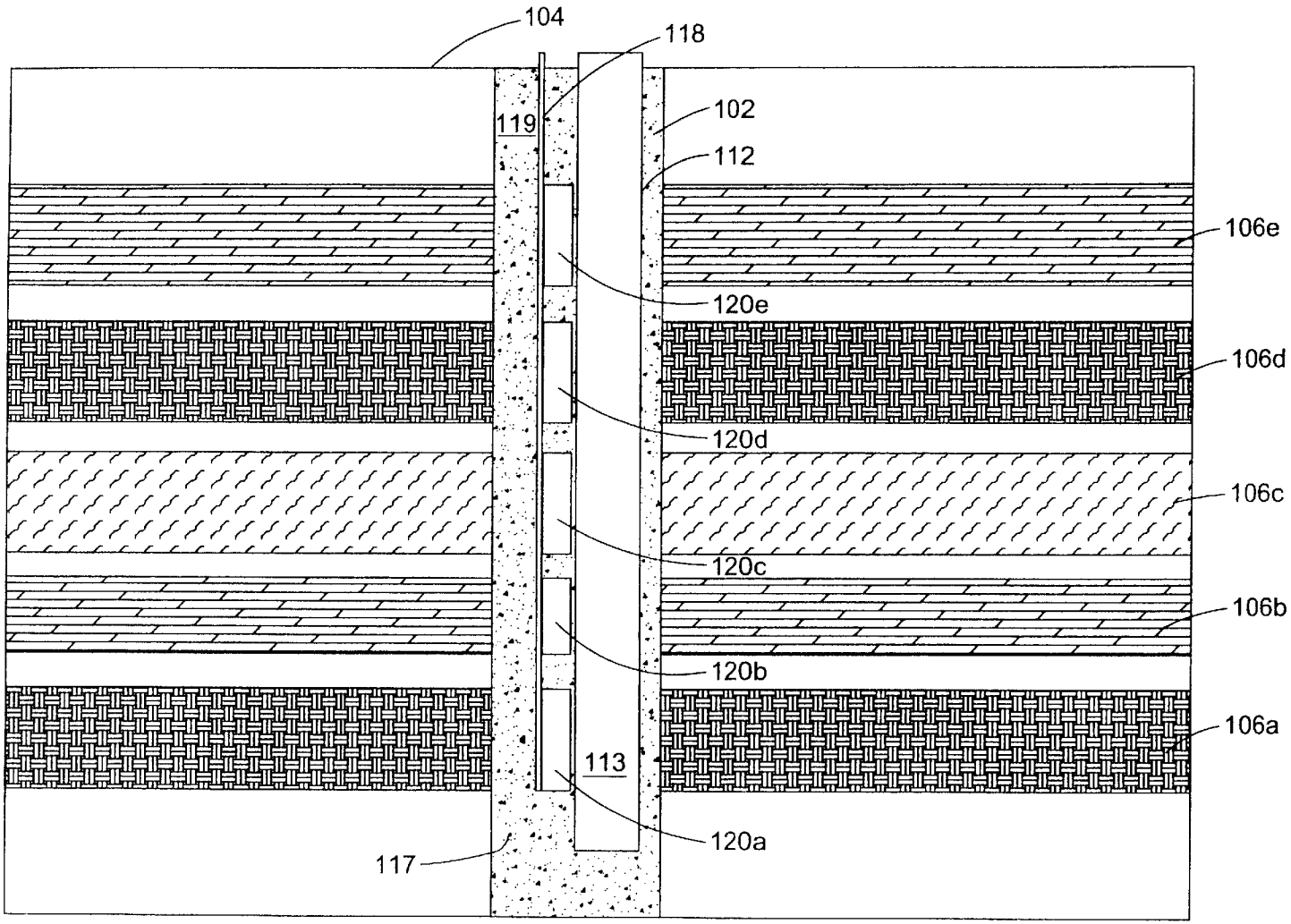
FIG. 9 is a partially cut away, partially sectional view of the assembly of the present invention, including a perforating gun assembly having multiple explosive charges, as positioned and cemented in a subterranean well bore.

In a further embodiment of the present invention, the assembly of the present invention is constructed of casing 112 and multiple perforating gun assemblies 120*a–e* (FIG. 9). As assembled and positioned within well bore 102, the perforating gun assemblies are positioned on the exterior of casing 112 adjacent the outer diameter thereof. It is preferred that the perforating gun assemblies 120*a–e* be secured to casing 112 by any suitable means, for example by metal bands wrapped around both casing 112 and perforating gun assemblies 120*a–e* or a specialty connector, to ensure that the relative position between each perforating gun assembly 120 and casing 112 as fully assembled does not substantially change during positioning of the assembly of the present invention in well bore 102. Each perforating gun assembly has at least one explosive charge which is aimed so as to perforate the casing upon detonation thereof. The assembly of the present invention is preferably fully constructed at the well site, i.e. either onshore well head or offshore platform, at the surface 104 prior to running the assembly into well bore 102. As illustrated in FIG. 9, a signal means 118, for example an electric line, extends from a suitable power source (not illustrated) at the surface 104 to the perforating gun assemblies 120*a–e* to provide a power source for ignition.

Multiple perforating gun assemblies 120*a–e* are positioned within a subterranean well bore 102 adjacent multiple subterranean formations of interest 106*a–e* after the well bore is drilled but prior to completing the well. The assembly is positioned adjacent a subterranean formation of interest by any suitable means. The position of subterranean formations 106*a–e* will be known from open hole logs and drilling data as previously discussed. As the assembly is being positioned within the well bore, a cased hole log may be obtained and correlated with open hole logs to accurately position perforating gun assemblies 120*a–e* adjacent the subterranean formations 106*a–e* of interest. Often it is desirable to circulate fluid through the casing and the annulus defined between the casing and the well bore prior to cementing. As will be evident to a skilled artisan, the temperature of such fluid and of the cement during setting may cause the casing to contract or expand and such change should be taken into consideration during the initial placement of the assembly of the present invention in the well bore, especially where the formation of interest is relatively thin. Once the perforating gun assemblies are properly positioned within the well bore, cement 117 is circulated either down through the interior 113 of casing 112 and back to the surface via the annulus 119 formed between the casing and the well bore or, alternatively, down annulus 119 and through casing 112 up to the surface. Prior to cement 117 being fully cured, casing 112 may be axially reciprocated to ensure that the cement is uniformly positioned about casing 112. As thus constructed, the multiple perforating gun assemblies 120*a–e* which are positioned adjacent subterranean zones of interest 106*a–e* may be subsequently detonated simultaneously, sequentially or in any desired order by transmission of a suitable signal to each perforating gun assembly via electrical, hydraulic, audio wave or any other suitable means.

Figure 6:
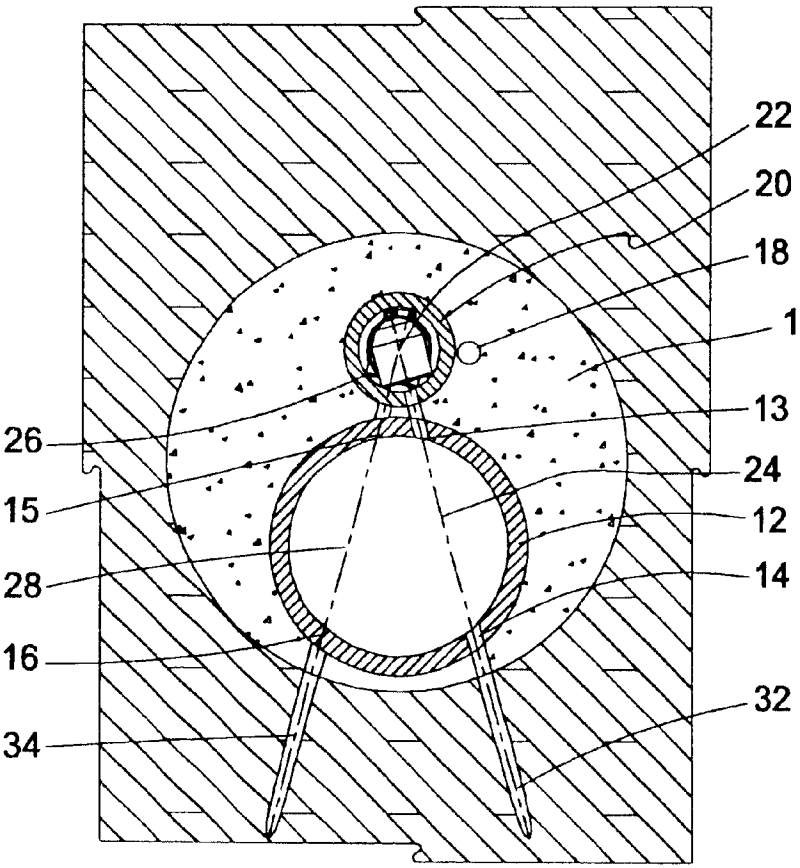
FIG. 6 is a cross sectional view of the assembly of the present invention as positioned and cemented within a subterranean well bore taken along the line 5—5 of FIG. 4 after at least one explosive charge of a perforating gun has been detonated.
Figure 7:
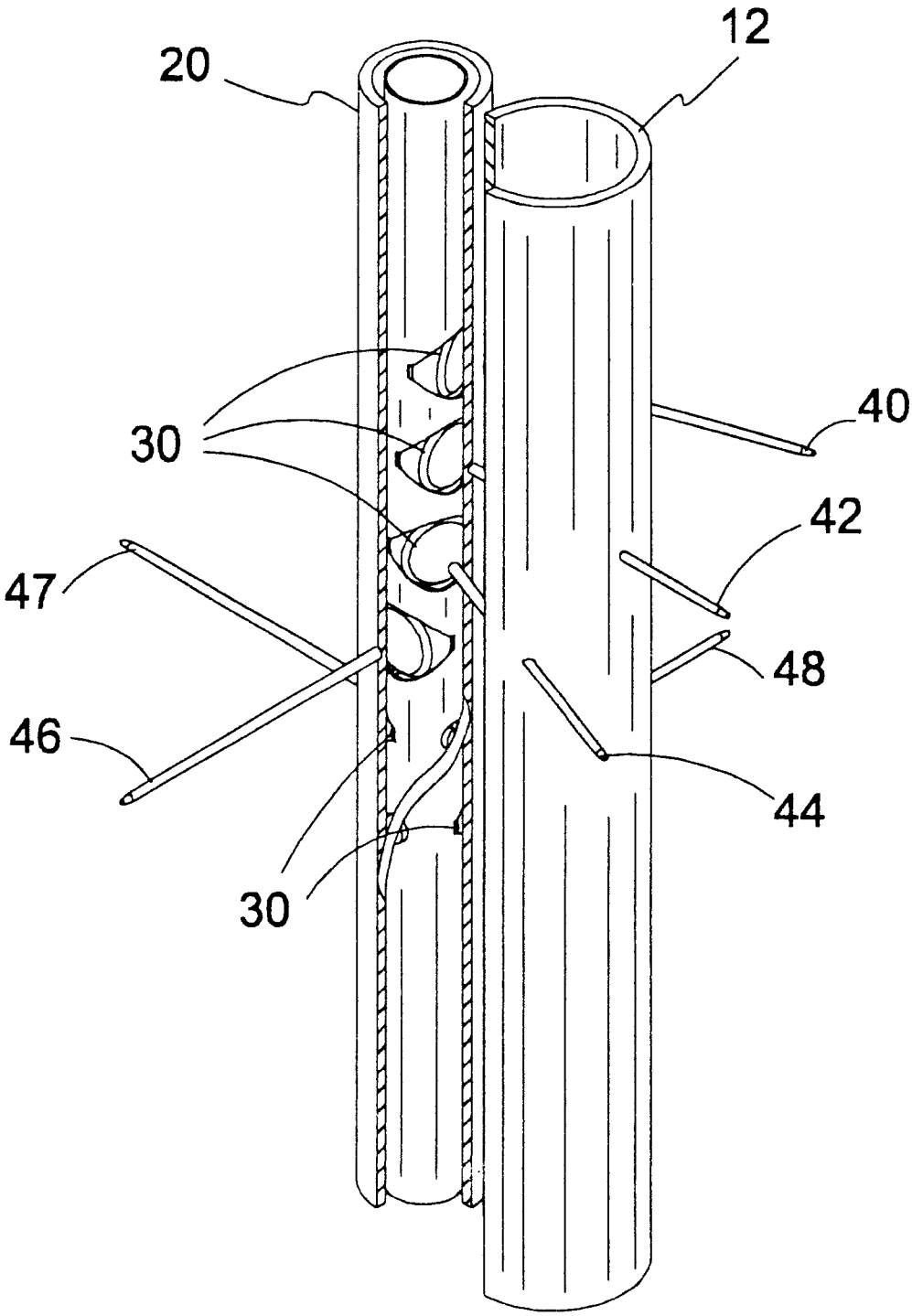
FIG. 7 is a partially cut away, perspective view of the assembly of the present invention, including a perforating gun assembly having multiple explosive charges, as detonated.
Figure 8:
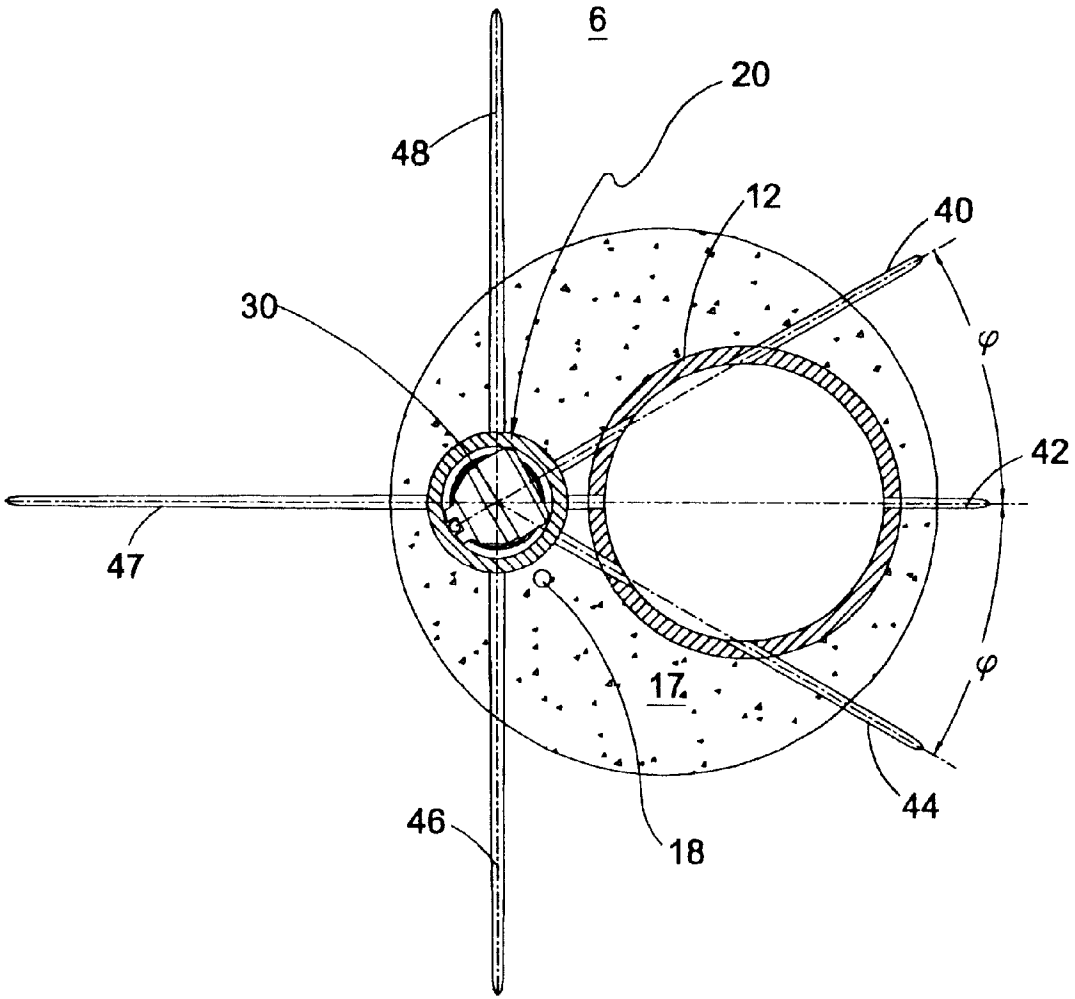
FIG. 8 is a top view of the assembly of the present invention depicted in FIG. 7 as positioned and cemented within a subterranean well bore and detonated, which illustrates one embodiment of charge phasing.
Figure 10A:
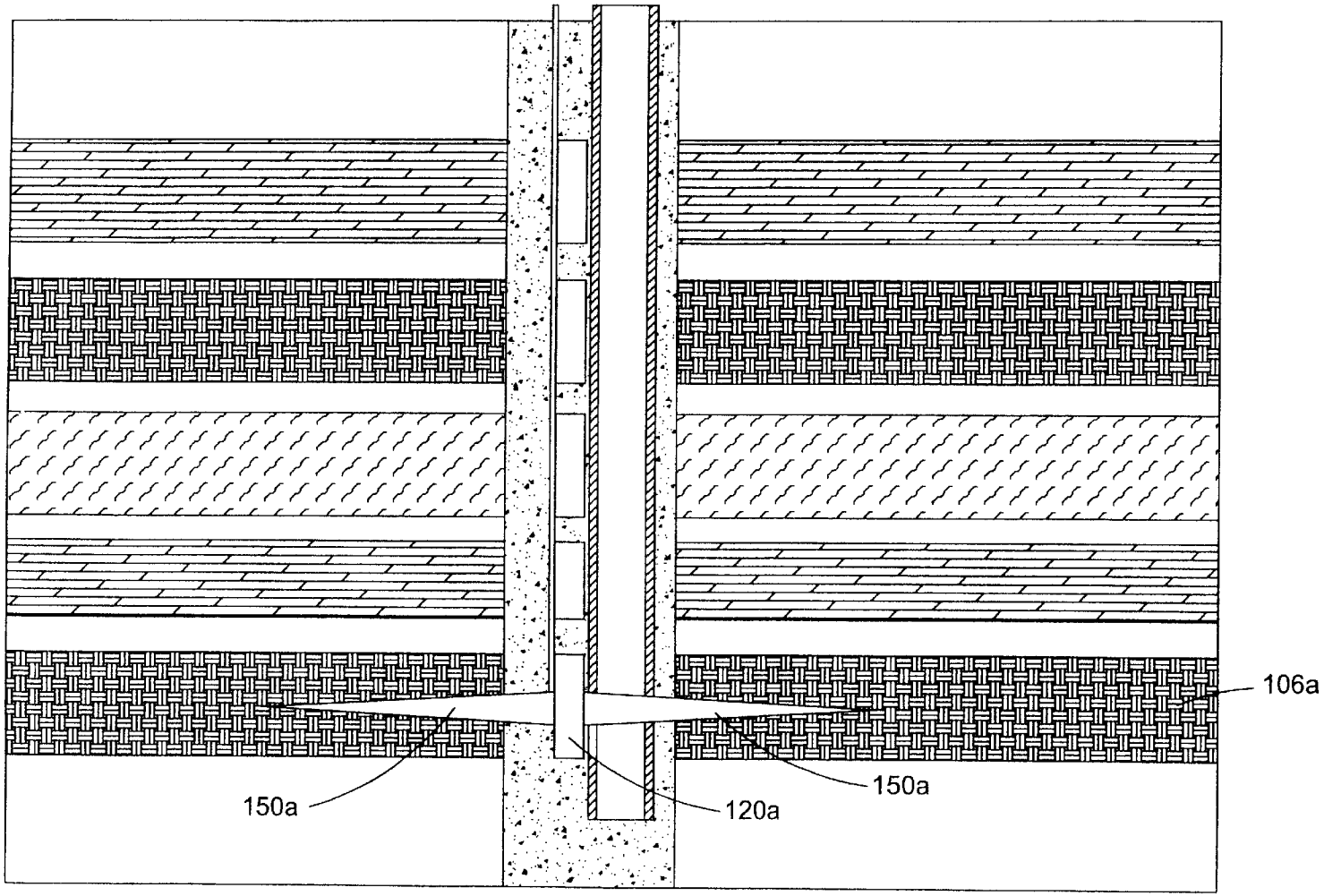
FIGS. 10*a–g* are partially cut away, schematic views of one embodiment of the present invention wherein multiple subterranean formations are stimulated and/or treated.
Figure 10B:
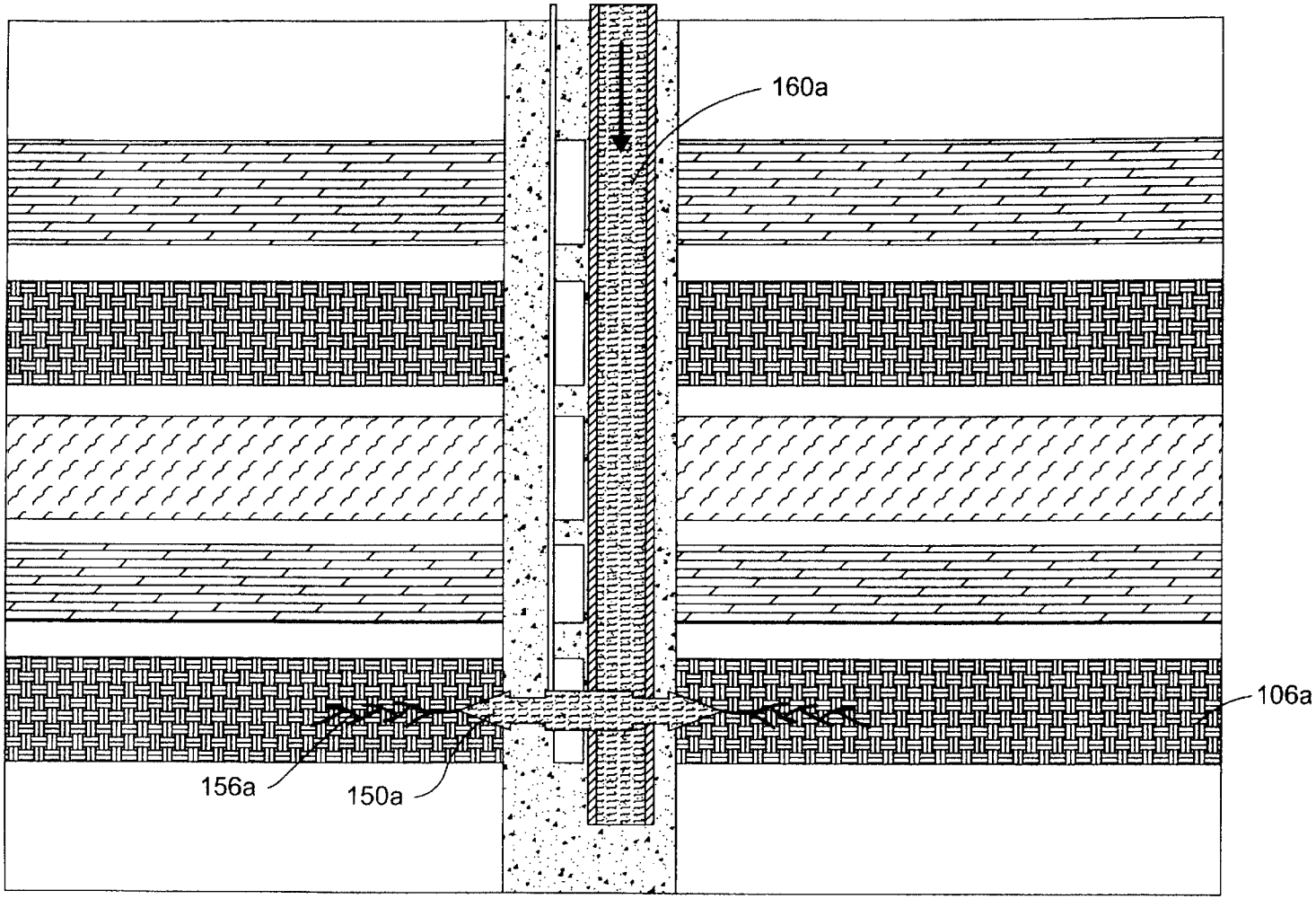
Figure 10C:
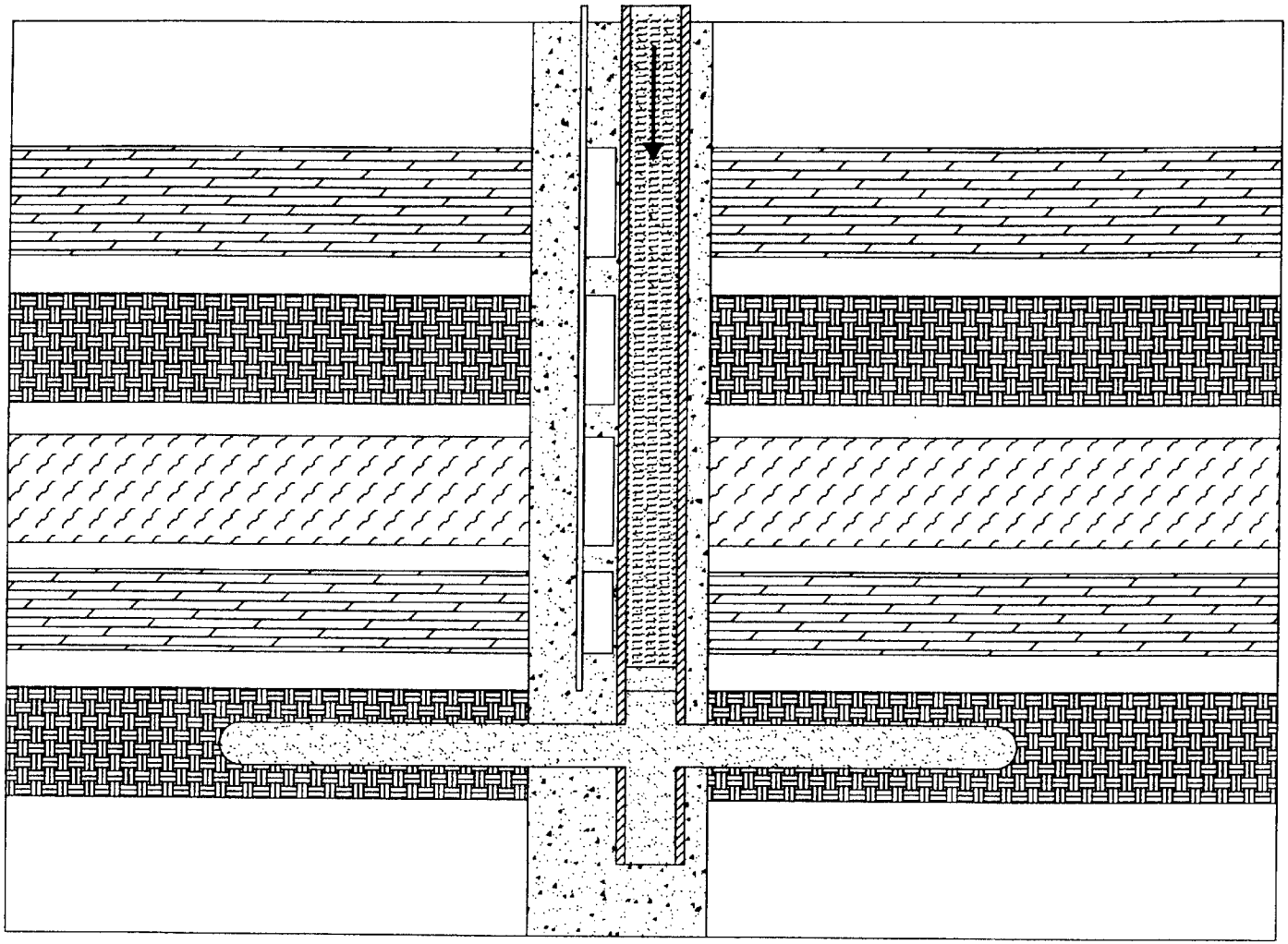
Figure 10D:
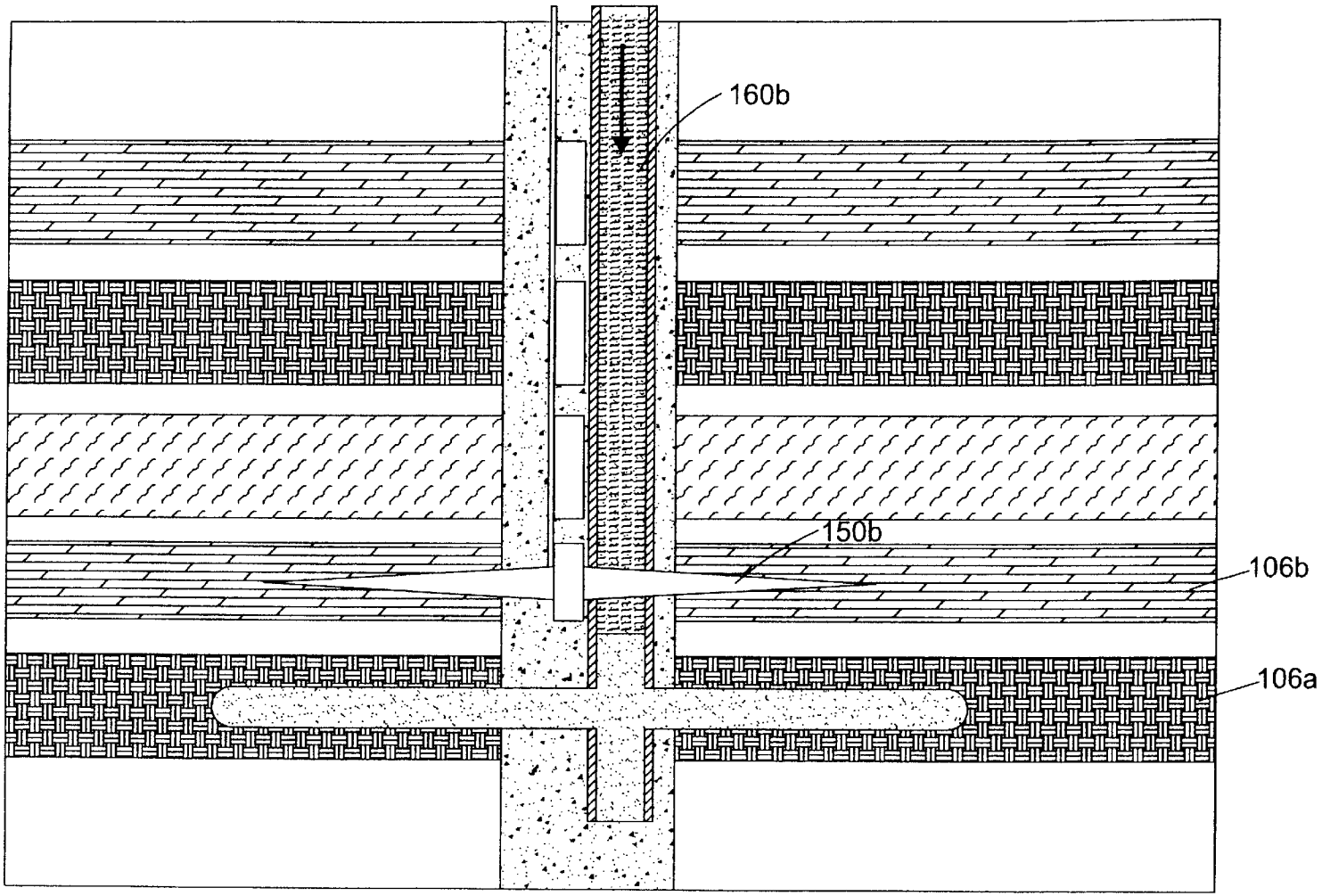
Figure 10E:
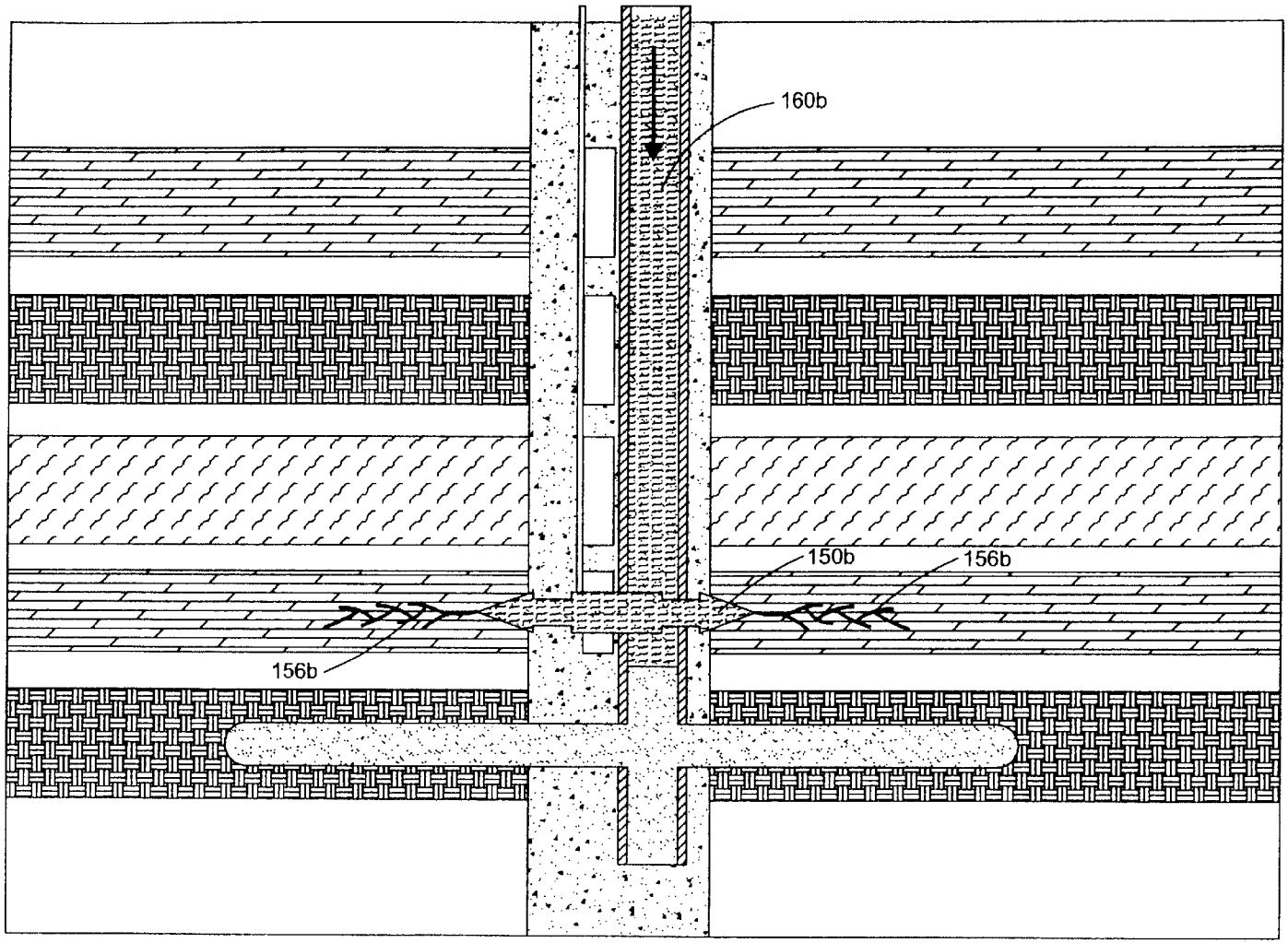
Figure 10F:
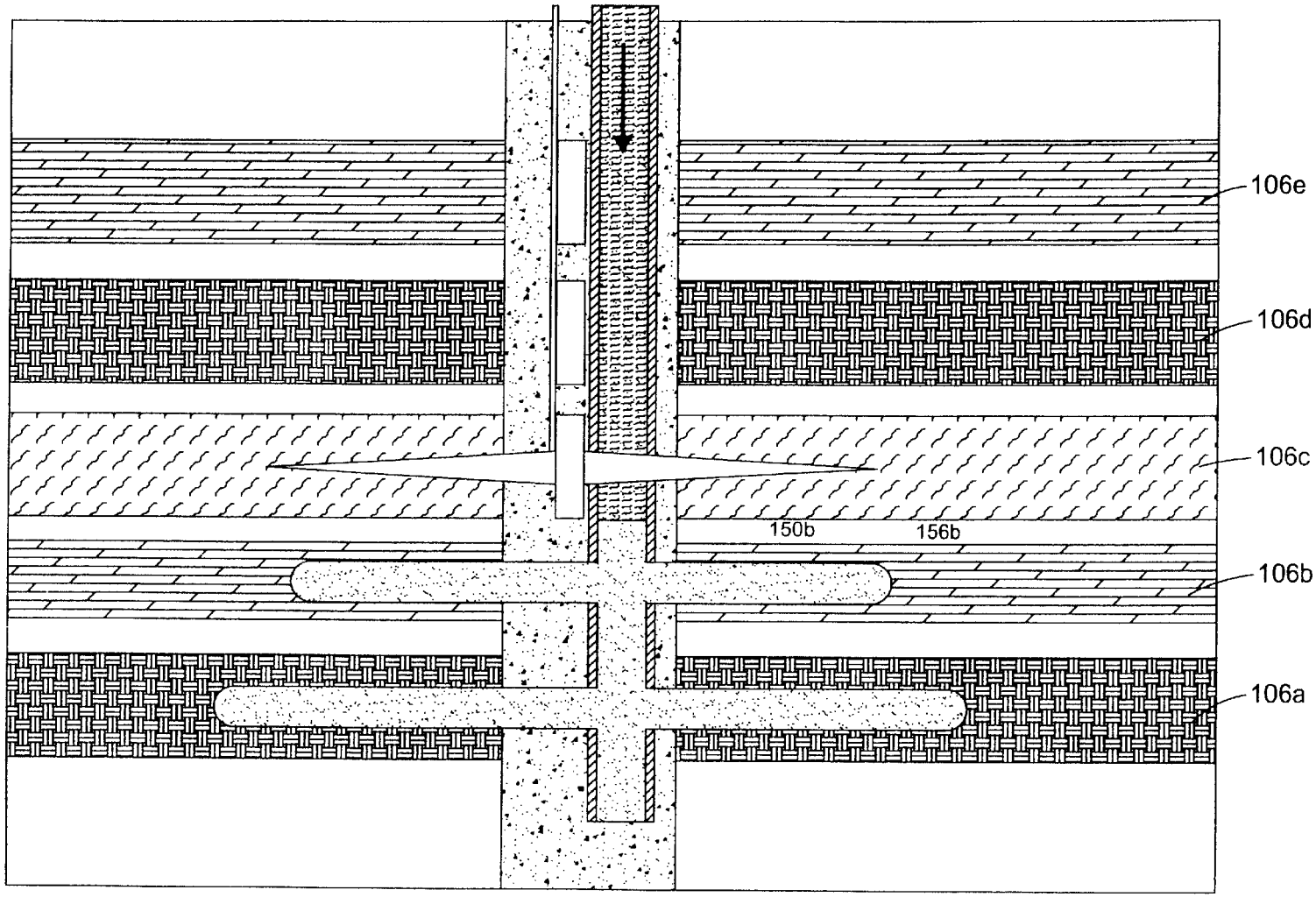
Figure 10G:
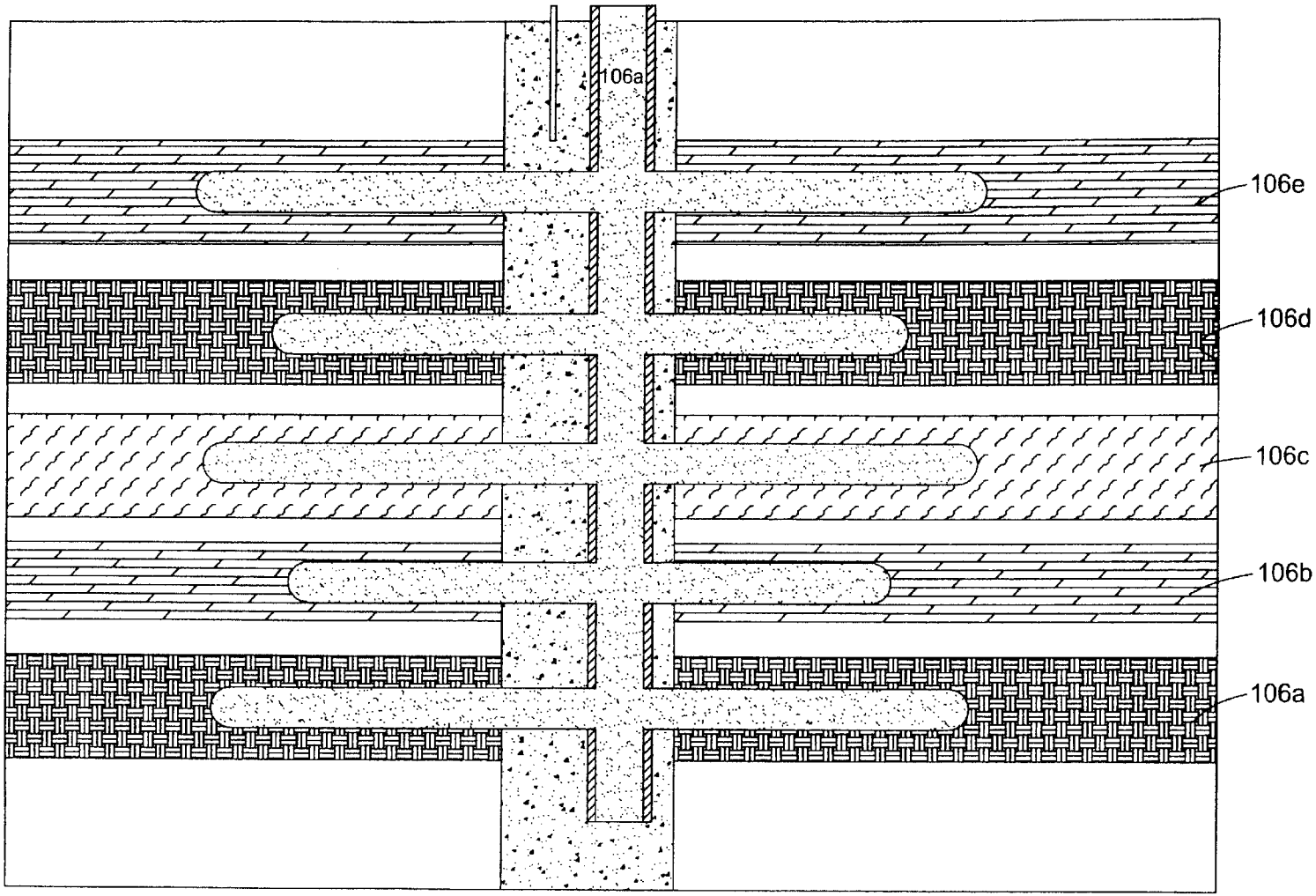

In accordance with one aspect of the embodiment of the present invention which is illustrated in FIG. 9, perforating gun 120*a* is fired or detonated upon receiving a signal via signal means 118 thereby forming perforation(s) 150*a* (FIG. 10*a*) through casing 112 and cement 117 into formation 106*a* in a manner as previously described with respect to the embodiments illustrated in FIGS. 6–8 above. Thereafter, stimulation fluids 160*a*, such as fracturing fluid containing proppants and/or acids containing balls which act as diverting agents in the formation, and/or treatment fluids, for example scale inhibitors and/or gelation solutions, are pumped from surface 104 through the interior 113 of casing 112 and into perforations 150*a* (FIG. 10*b*). Radioactive tracers may be incorporated into the stimulation and/or treatment fluids to ensure proper placement of fluids and/or solids contained therein. In the case of fracturing fluids, fractures 156*a* are formed and propagated within formation 106*a*. Where stimulation fluids, such as acidizing fluids, and/or treatment fluids are employed, these fluids need not be pumped at pressures sufficient to create fractures 156*a*. As the stimulation and/or treatment process continues, screen out occurs during the pumping operation when the proppant and/or balls create a significant flow restriction in the well bore 102. At this point (FIG. 10*c*), the process may be suspended, for example where it is desirable to produce fluids from formation 106*a* for testing and/or evaluation purposes, or the next formation 106*b* may be immediately treated in a similar fashion to that just described with respect to formation 106*a* (FIGS. 10*d–f*). This process is repeated for each zone to be treated until conclusion (FIG. 10*g*).

In accordance with another embodiment of the assembly of the present invention which is illustrated in FIG. 11, zone isolation devices 230*a* and 230*b* are secured to casing 212 between perforating gun assemblies 220*a–c*. As illustrated, the zone isolation devices are connected to signal means 218 and preferably are secured to casing 212 by any suitable means, for example by screw threads or welds. Suitable zone isolation devices, for example flapper valves or ball valves, are employed in the process of the present invention as hereinafter described to selectively shut off flow through the interior 213 of casing 212. In operation, perforating gun 220*a* is fired or detonated upon receiving a signal via signal means 218 thereby forming perforation(s) 250*a* (FIG. 11*a*) through casing 212 and cement 217 into formation 206*a* in a manner as previously described with respect to the embodiments illustrated in FIGS. 6–10 above. Thereafter, stimulation fluids 260*a*, such as fracturing fluid containing proppants and/or acids, and/or treatment fluids, for example scale inhibitors and/or gelation solutions, are pumped from surface 204 through the interior 213 of casing 212 and into perforations 250*a* (FIG. 11*b*). Radioactive tracers may be incorporated into the stimulation and/or treatment fluids to ensure proper placement of fluids and/or solids contained therein. In the case of fracturing fluids, fractures 256*a* are formed and propagated within formation 206*a*. Where stimulation fluids, such as acidizing fluids, and/or treatment fluids are employed, these fluids need not be pumped at pressures sufficient to create fractures 256*a*. When the stimulation and/or treatment process is completed, a signal is sent to isolation device 230*a* and perforating gun 220*b* via signal means 218. In response, perforating gun 220*b* is fired or detonated thereby forming perforation(s) 260*b* (FIG. 11*c*) while isolation device 230*a* is activated to seal interior 213 of casing 212 against fluid flow. Detonation of perforating gun 220*b* and activation of isolation device 230*a* may occur substantially simultaneously or sequentially although it is preferred that perforating gun 220*b* be fired immediately before isolation device 230*a* is activated. At this point (FIG. 11*d*), the next formation 206*b* is immediately treated in a similar fashion to that just described with respect to formation 206*a* (FIG. 11*d*). The surface equipment necessary to pump the stimulation and/or treatment fluids through casing 212 need not be moved off the surface well site during operation in accordance with the present invention nor rigged up or down thereby saving costs associated with such operations. This process is repeated for each zone to be treated (FIG. 11*e*) until conclusion (FIG. 11*f*). Upon completion, zone isolation devices 230*a* and 230*b* may be actuated into an open position or destructed by any suitable means, such as drilling, to permit flow through the interior 213 of casing 212 for fluids produced from and/or injected into formations 206*a*, 206*b* and/or 206*c*. Although illustrated in FIGS. 11*a–*11*f* as being applied to three formations, the process illustrated for this embodiment of the present invention may be applied to any number of subterranean formations which are penetrated by a subterranean well bore.

Figure 12A:
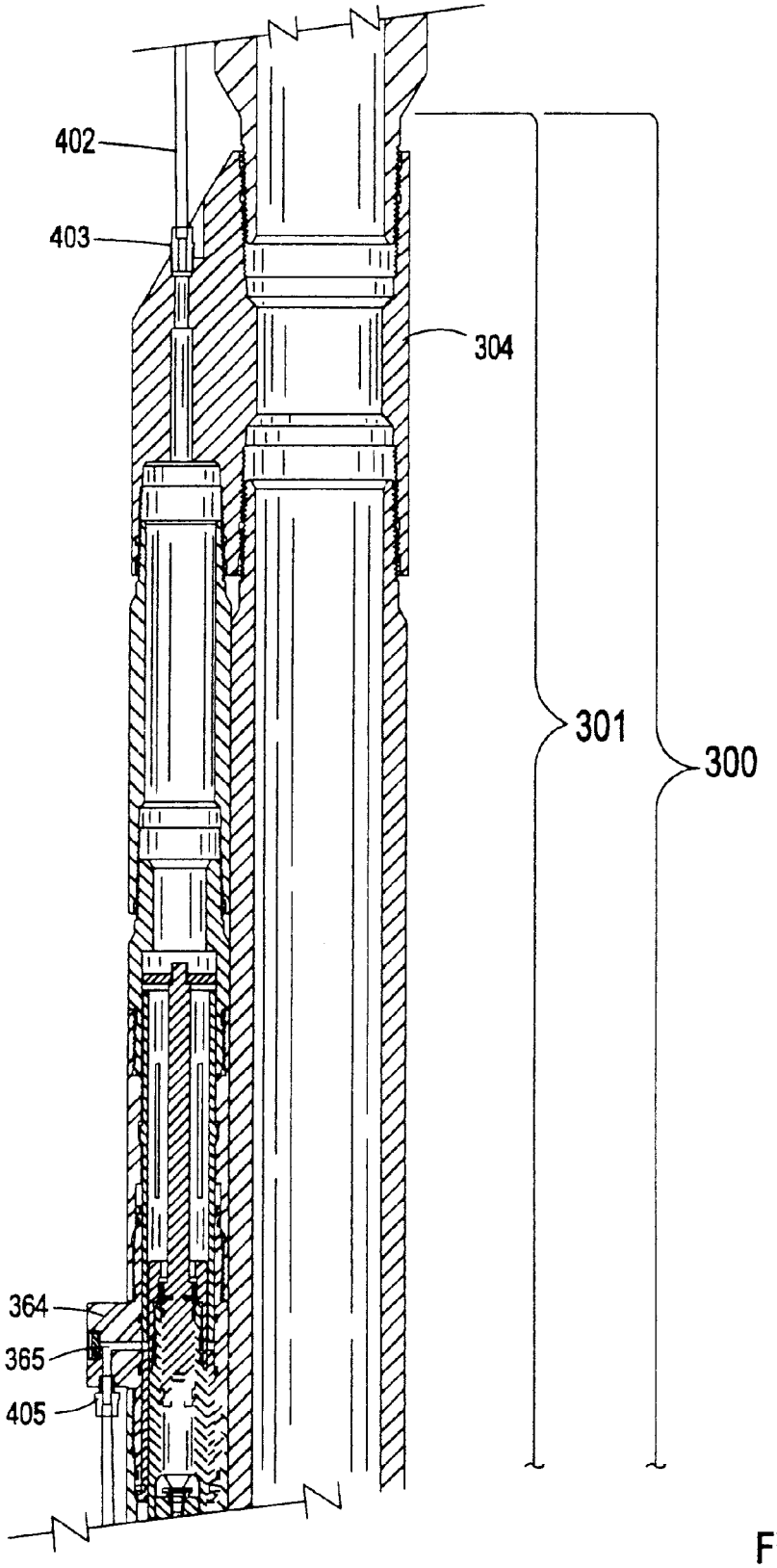
FIGS. 12*a*, 13*a*, 14*a*, 15*a* and 16*a* are partial cross sectional views which, as combined in the sequence noted, illustrate another embodiment of the present invention which is utilized to stimulate and/or treat multiple subterranean formations wherein flapper valve sub-assemblies are positioned between perforating gun assemblies.
Figure 12B:
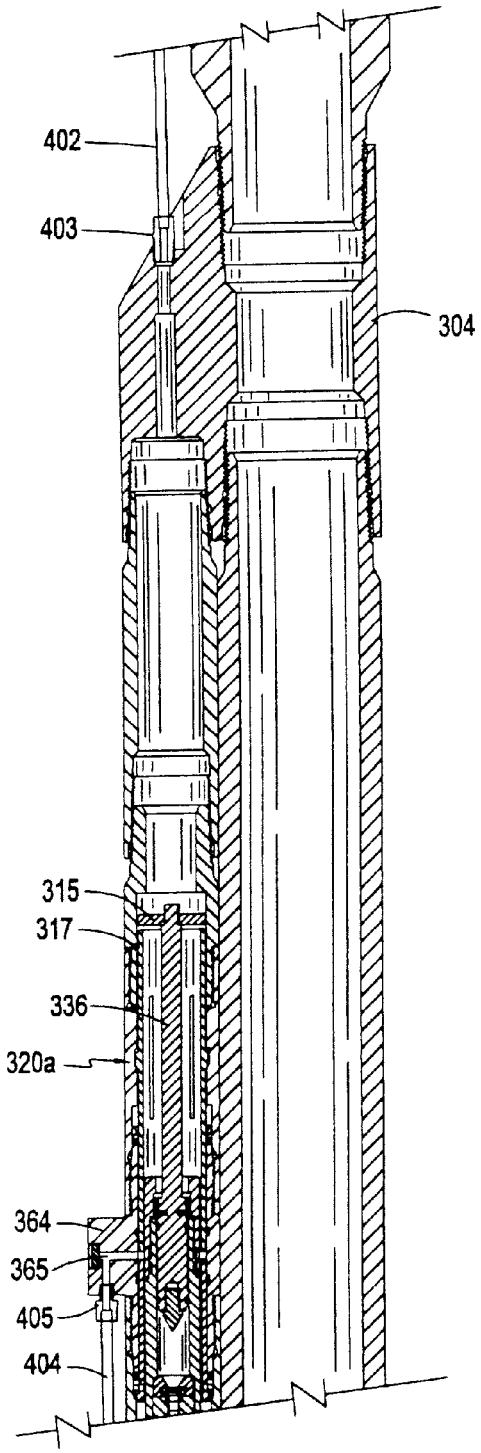
FIGS. 12*b*, 13*b*, 14*b*, 15*b* and 16*b* are partial cross sectional views which, as combined in the sequence noted, illustrate another embodiment of the present invention which is utilized to stimulate and/or treat multiple subterranean formations wherein flapper valve sub-assemblies are positioned between perforating gun assemblies and wherein one of the perforating gun assemblies has been detonated.
Figure 12C:
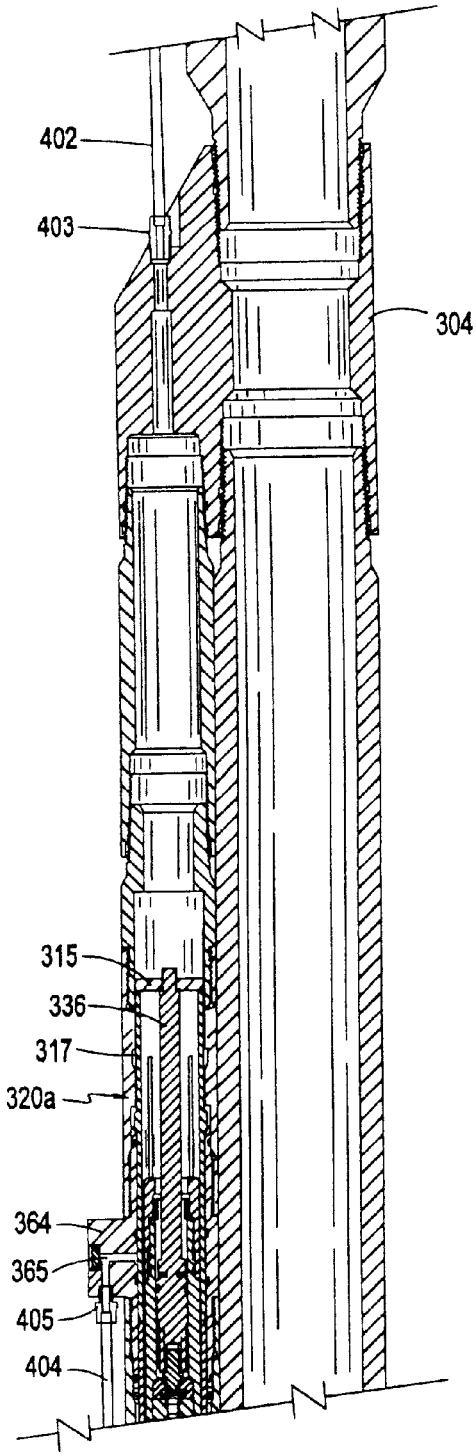
FIGS. 12*c*, 13*c*, 14*c*, 15*c* and 16*c* are partial cross sectional views which, as combined in the sequence noted, illustrate another embodiment of the present invention which is utilized to stimulate and/or treat multiple subterranean formations wherein flapper valve sub-assemblies are positioned between perforating gun assemblies and wherein both of the perforating gun assemblies have been detonated.
Figure 13A:
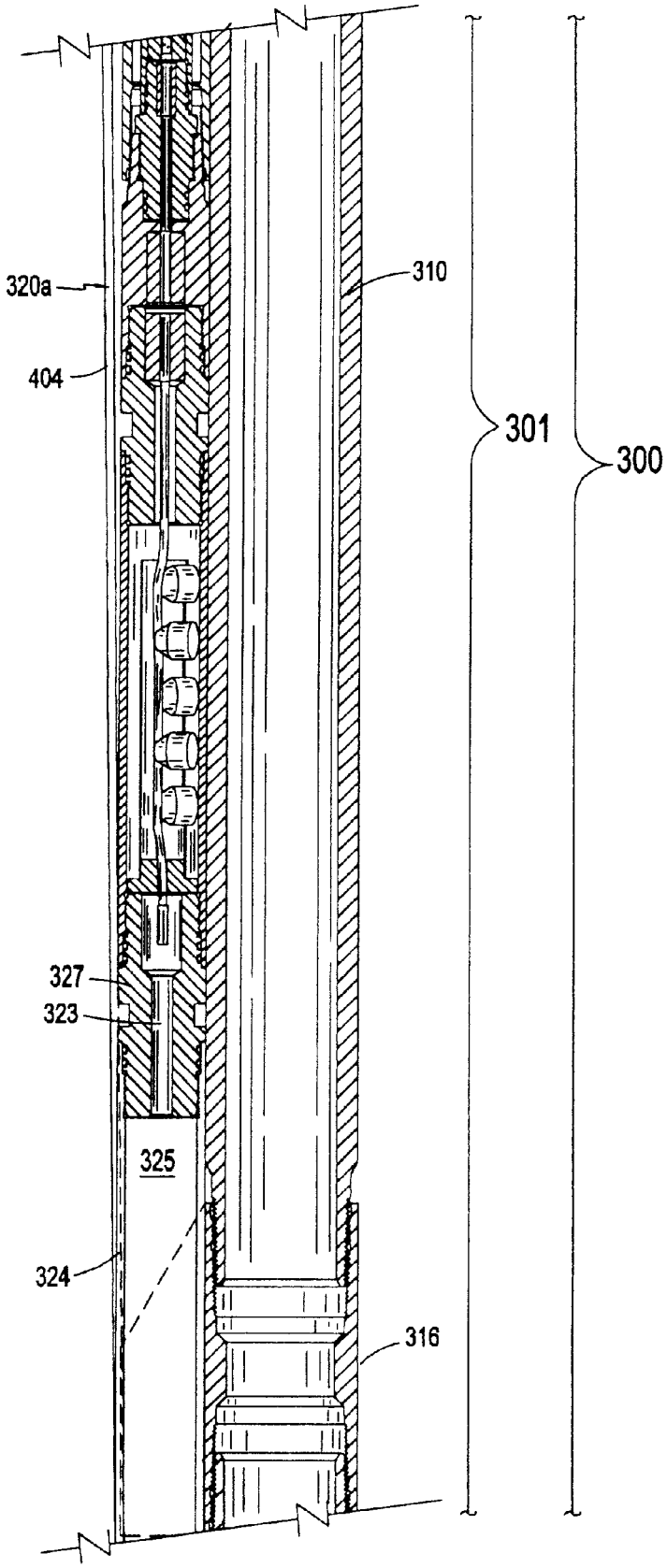
Figure 13B:
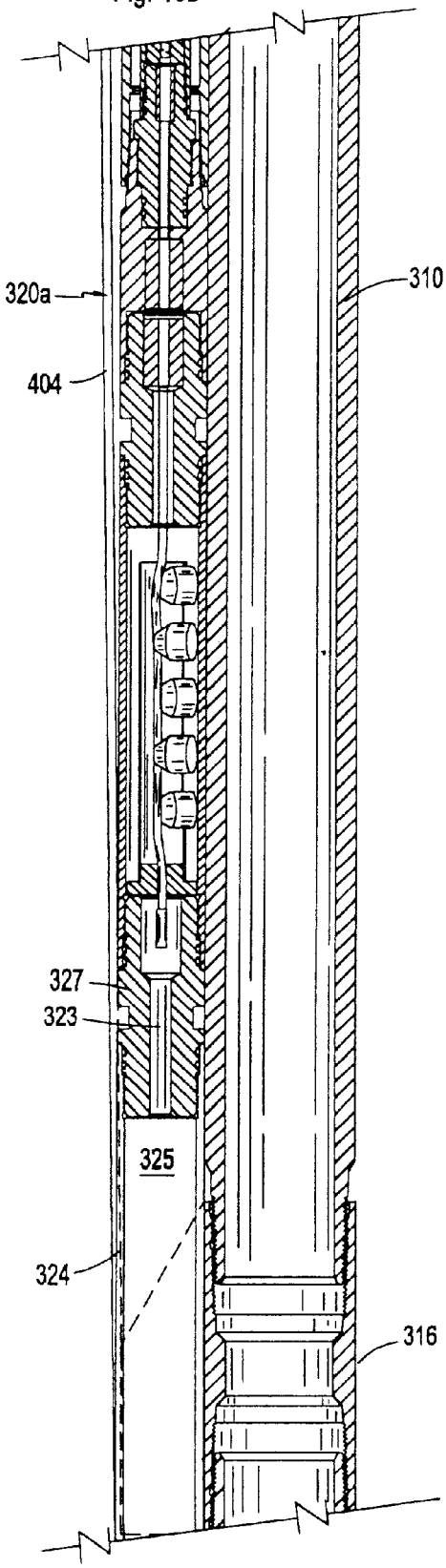

An embodiment of the assembly and process of the present invention which utilizes zone isolation devices between perforating gun assemblies is illustrated generally as 300 in FIGS. 12*a–*16*a* and comprises at least two perforating gun assemblies 320 and 320*a* which are secured to the outside of casing 310 which is made up of individual lengths of pipe in a manner as described below and a flapper valve assembly 380 which is positioned between perforating gun assemblies 320, 320*a* as described below. A first length of casing 310, a first speciality collar 304, a first male to female connector 314, a flapper valve sub-assembly 380, a second length of casing 310, a collar 316, a third length of casing 310 and a second specialty collar 312 are secured together in the sequence as just described and illustrated in FIG. 12 by any suitable means, such as screws threads. As illustrated in FIGS. 12 and 13, each specialty collar 304 has a first generally cylindrical shaped, axially extending bore 305 therethrough having screw threaded ends and a second smaller diameter axially extending bore 306 which is axially offset from bore 305 and having an enlarged end 307 which is provided with screw threads for engagement with a perforating gun assembly and a second end which is threaded for engagement with a hydraulic line as hereinafter described.

Flapper valve subassembly 280 comprises generally tubular body sections 381, 383, 385 and 386 which are secured together by any suitable means, such as by screw threads. O-ring seals 382, 388 and 387 provide a fluid tight connection between these generally tubular body sections. Body section 383 is provided with a port 389 which provides for fluid communication through the wall of section 383 and is threaded on one end for attachment to a hydraulic line as hereinafter described. A sleeve 400 is received within body sections 381, 383, 385 and 386 such that, when assembled in the positioned illustrated in FIGS. 14*a* and 15*a*, two annular chambers 394 and 395 are defined therebetween. Sleeve 400 has a raised outer portion 402 intermediate the length thereof thereby defining opposing generally annular shoulders 404 and 406. Sleeve 400 may move with respect to the body sections with the amount of movement being limited by raised outer portion 402 abutting the ends of annular chamber 395 Annular seal rings 392 and 393 provide a fluid tight seal between sleeve 400 and body sections 381 and 383. A flapper valve 396 is rotatably secured to body portion 386 and is biased toward a closed position in engagement with generally annular seat 399 formed by one end of body portion 386 by means of spring 398 so as to block fluid flow through the interior bore 390 of the sub-assembly. As assembled, flapper valve 396 is positioned in an open, retracted position within annular chamber 394 and held therein by sleeve 400. Sleeve 400 is held in this position by means of ambient air pressure in chamber 395 acting against shoulder 404. Flapper valve 396 is constructed of any suitable material, for example ceramic or relatively soft metal such as aluminum or cast iron, which may be removed by rotary drilling or percussive means.

Figure 16A:
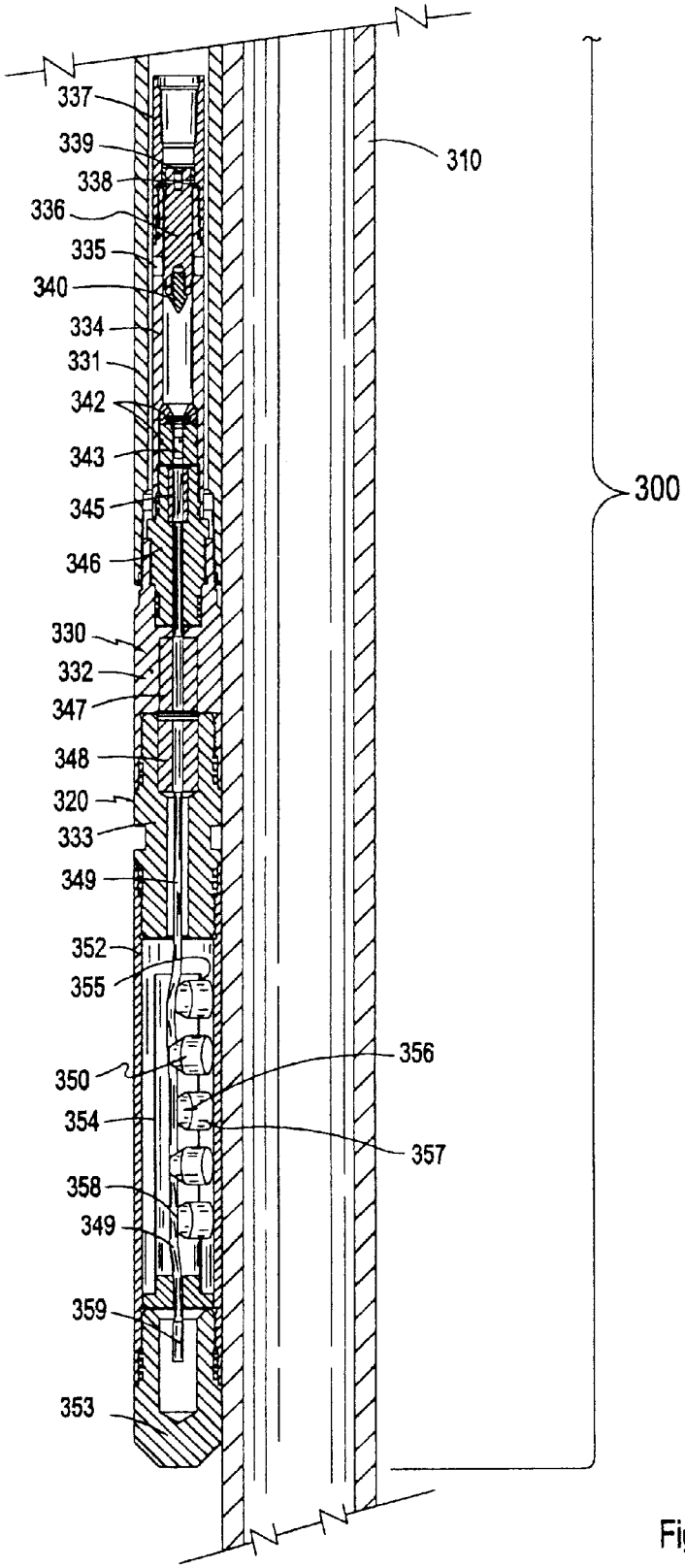
Figure 16B:
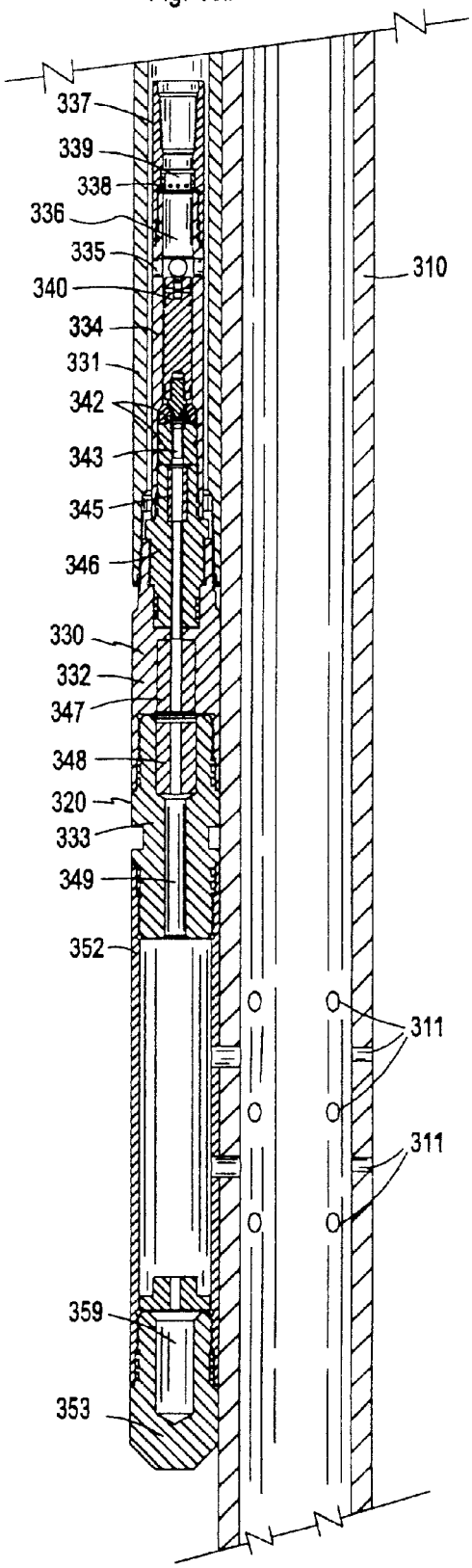
Figure 16C:
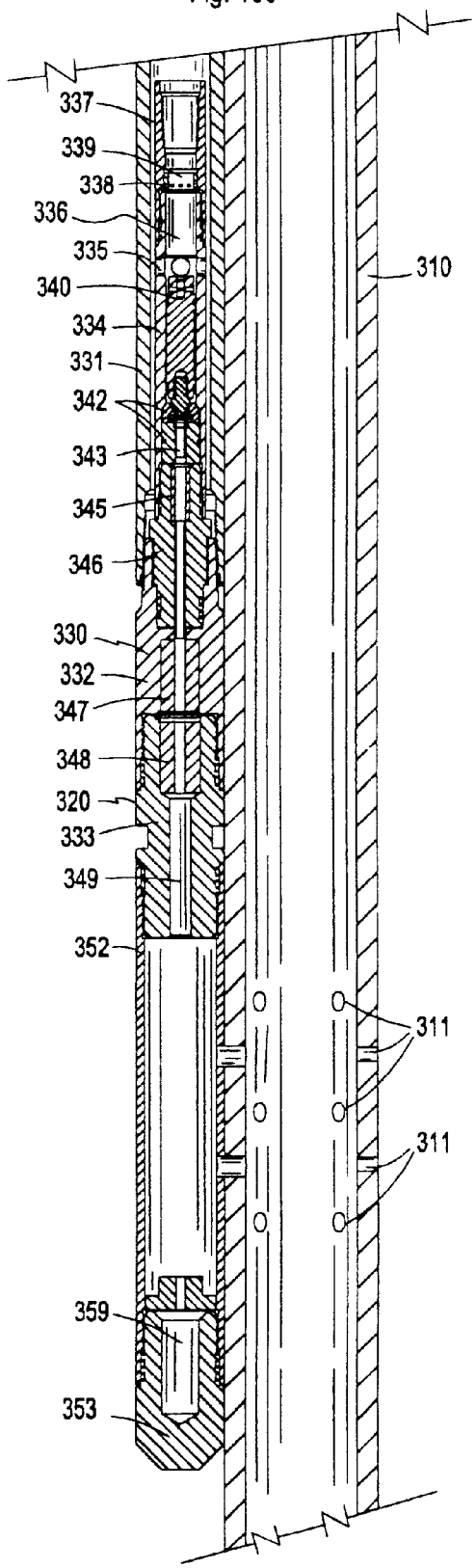
Figure 17:
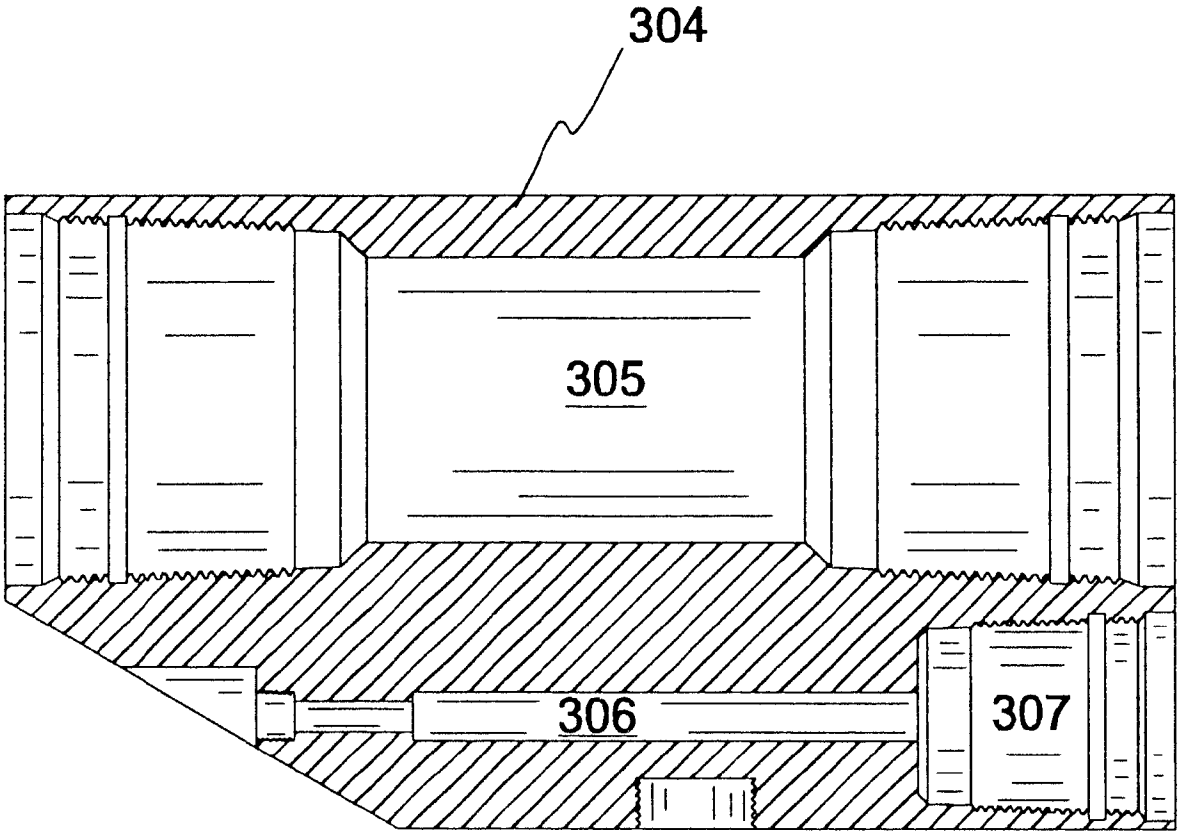
FIG. 17 is a sectional view of a specialty collar utilized in the embodiment of the present invention which is illustrated FIGS. 12*a*–16*a* as assembled.

Perforating gun assemblies 320 and 320*a* each comprise a detonating assembly 330 and a perforating gun 350. Any suitable detonating assembly known to those skilled in the art may be used. An example of a detonating assembly suitable for use with the casing conveyed perforating assembly of the present invention is shown in FIGS. 13*a* and 16*a*. One end of an outer generally cylindrical housing 331 is secured to enlarged end 307 of specialty collar 304 while the other end is secured to a second sub 332 which in turn is secured to a third sub 333 by any suitable means, such as by screw threads. In addition, the outer housing 331 of perforating gun assembly 320*a* has a outwardly extending spigot 364 which contains a bore 365 in fluid communication with in interior of outer housing 331 as hereinafter described in greater detail. Vent housing 334 which has a vent 335 formed intermediate the length thereof has one end thereof secured to internal sub 346 which in turn is secured to second sub 332. A piston 336 is received within vent housing 334 and tubular end cap 337 and is initially held in place by means of shear pins 338 mounted in shear set 339. Piston 336 is elongated and is connected to pin 315 in assembly 320*a*. A firing pin 340 extends from one end of the bottom of piston 336. An annular chamber 341 defined between piston 336 and firing head 342 is filled with air at atmospheric pressure. Firing head 342 abuts a shoulder in the interior wall of vent housing 334 in the detonator assembly as fully constructed and functions to retain percussion detonator 343 against an ignition transfer 345 in one end of internal sub 346. Internal sub 346 is secured to second sub 334 by any means, such as screw threads. Each of ignition transfer 345, internal sub 346, second sub 332 and third sub 334 are provided with an internal bore through which detonating cord 349 passes. Booster transfers 347, 348 are located in second and third subs 332, 334, respectively, linking segments of the detonating cord 349 above and below the junction between second and third subs 332, 334. One end of third sub is secured to one end of a perforating charge carrier 352 of perforating gun assembly 350 while the other end of charge carrier 352 is secured to bull plug 353 by any suitable means, such as screw threads. Charge carrier 352 may be a commercially available carrier for perforating charges and contains at least one conventional perforating charge 356 capable of creating an aperture in casing and a portion of the adjacent subterranean formation. A perforating charge tube 354 is positioned within carrier 352 and has at least one relatively large aperture or opening 355 therein which may be spaced both vertically along and angularly about the axis of the tube. Charge carrier 352 and perforating charge tube 354 have generally elongated tubular configurations. A lined perforating charge 356 is secured in an aperture or opening 355 in perforating charge tube 354 in a manner as will be evident to a skilled artisan, such that the large end 357 thereof is aligned with and protrudes through opening or aperture 355 in tube 354. If multiple charges are present, they may be spaced vertically along and angularly about the axis of the carrier. The charge density is an appropriate density determined by methods known to those skilled in the art. Common charge densities range between two and twenty four per foot. Detonating cord 349 is connected to the small end 358 of each perforating charge 356 and to end cap 359 in bull plug 353.

Figure 14A:
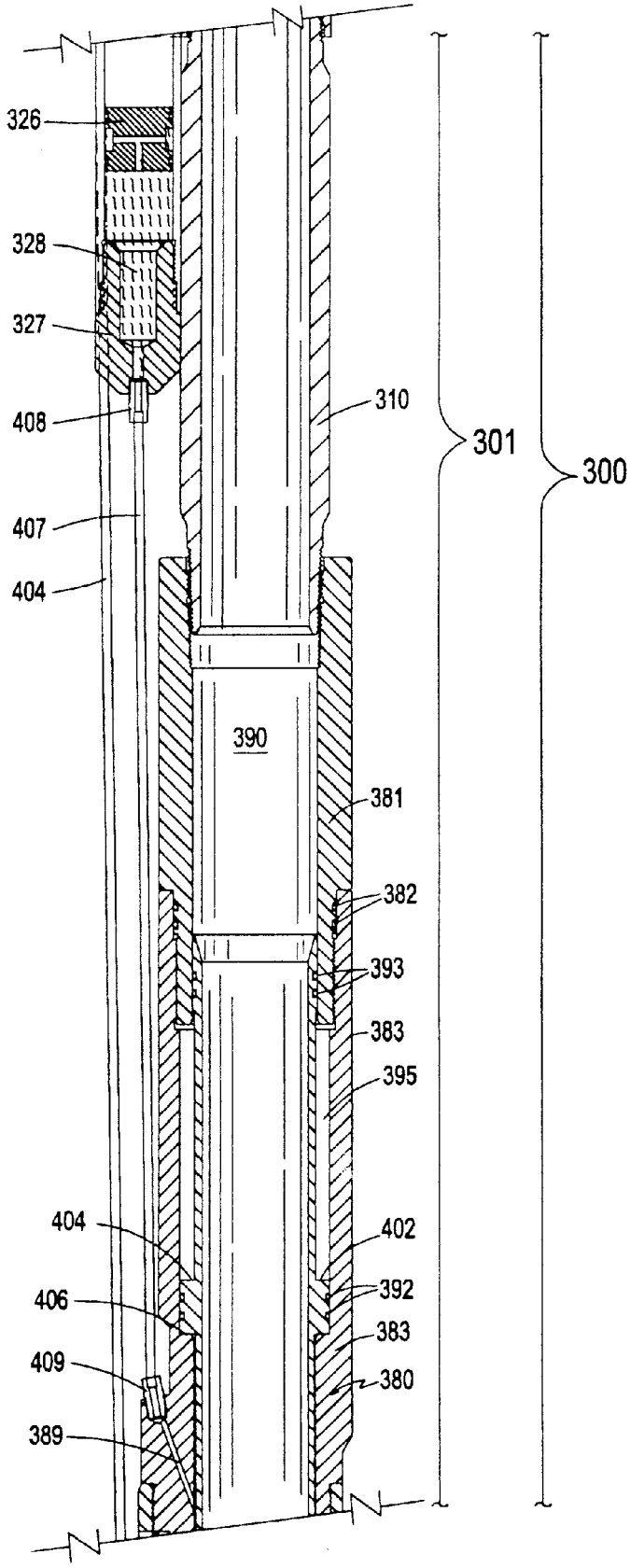
Figure 14B:
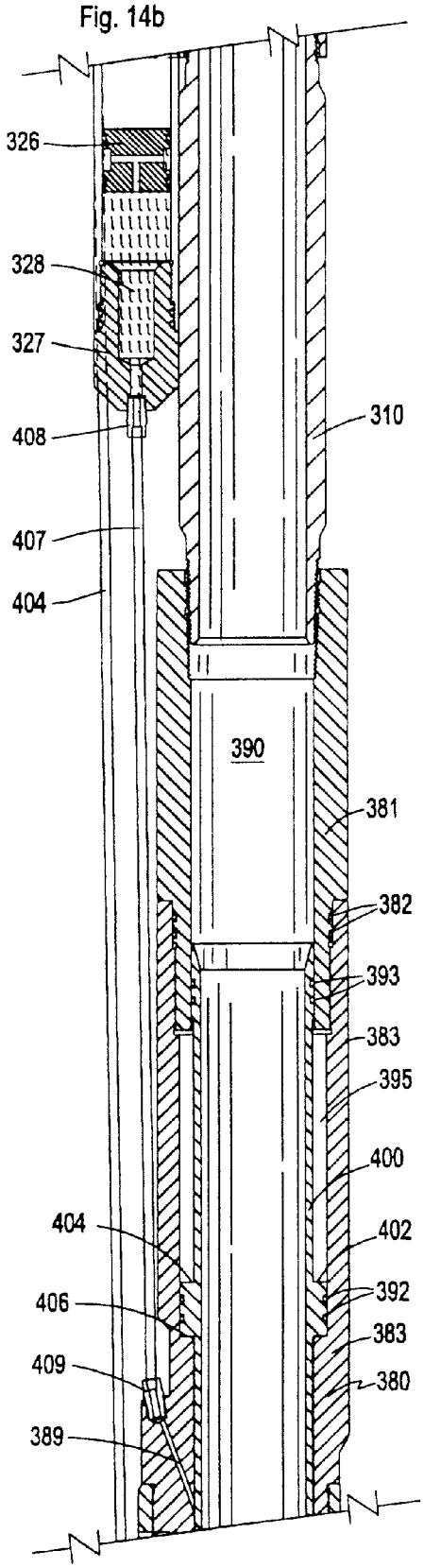
Figure 14C:
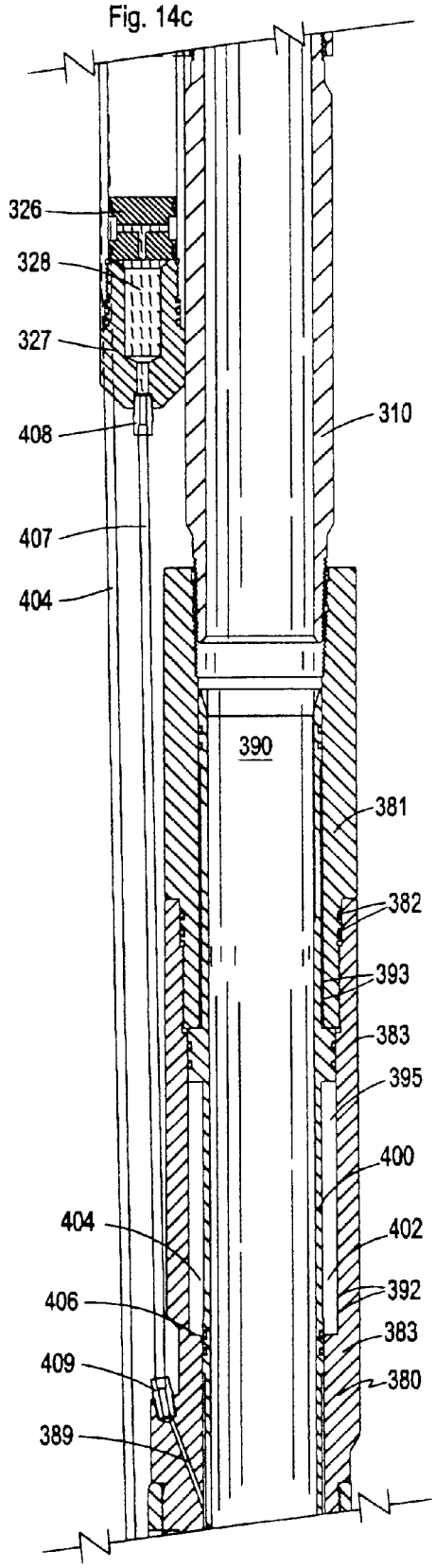
Figure 15A:
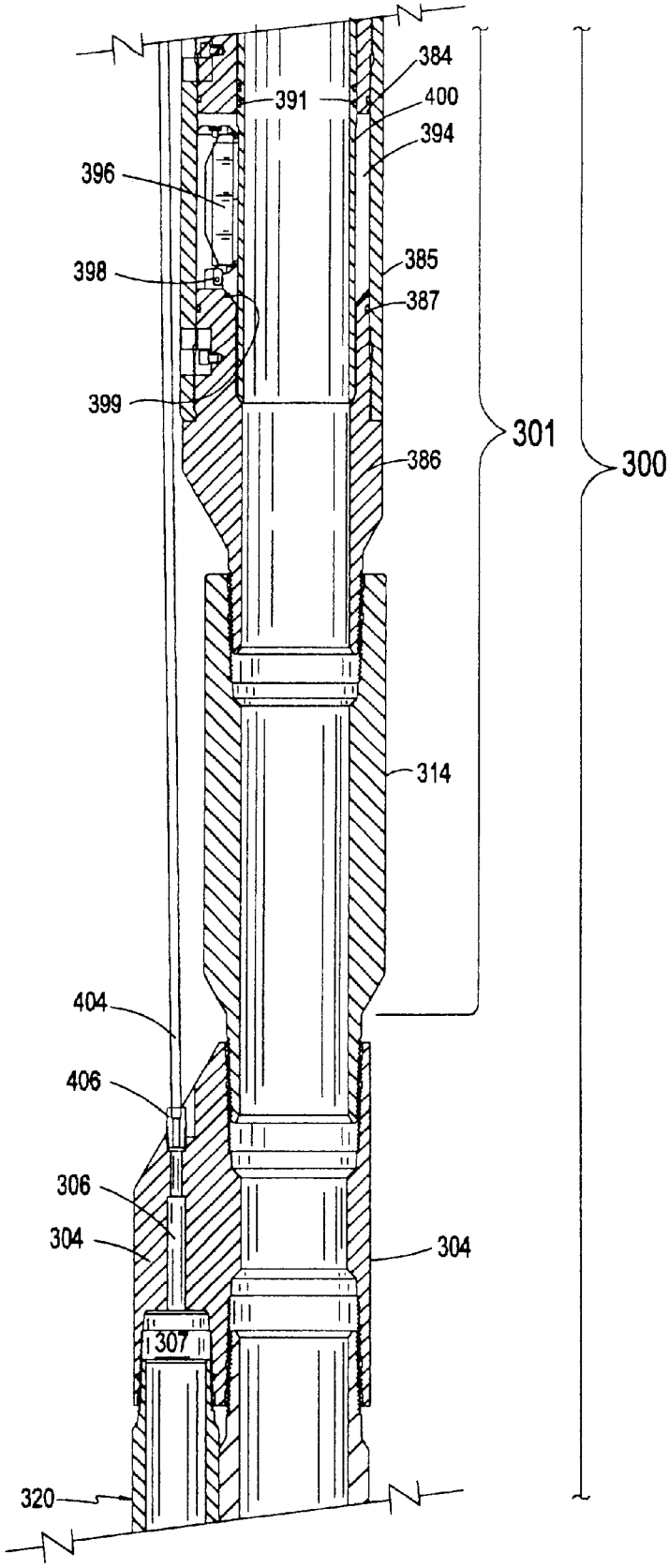
Figure 15B:
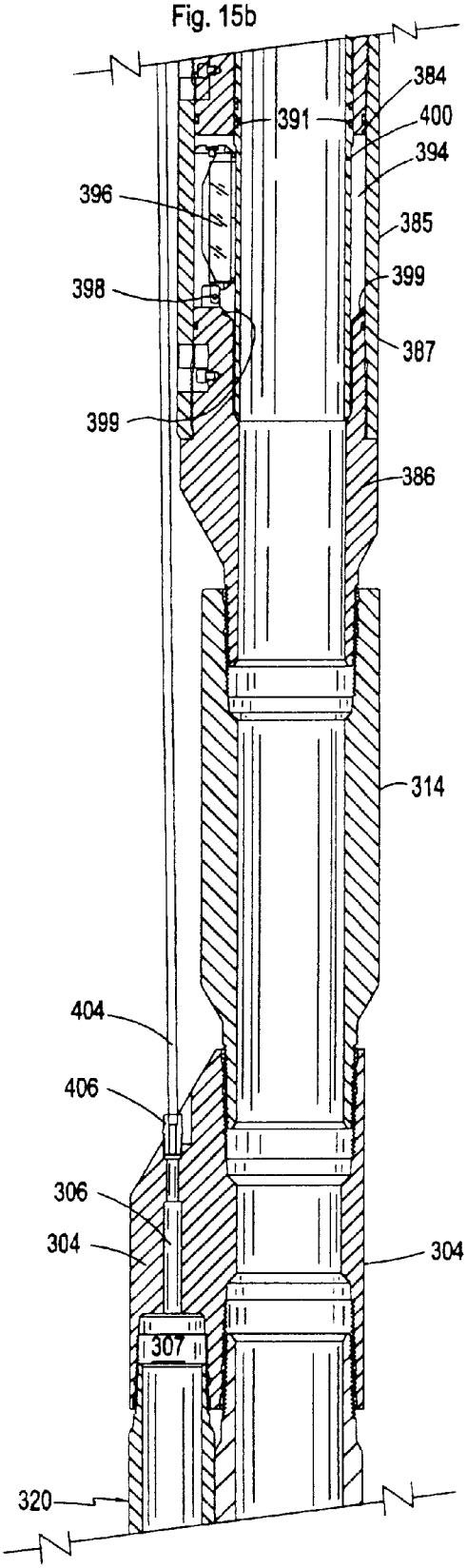

As illustrated in FIGS. 13*a* and 14*a*, perforating gun assembly 320*a* is provided with a sub 322 in lieu of a bull plug. Sub 322 has a bore 323 therethrough and is secured at the other end to piston housing 324 which slidingly receives a piston 326 in the interior 325 thereof. The other end of piston housing is connected to a plug 327 having a bore 328 therethrough which has one end thereof threaded for connection to a hydraulic line.

As assembled and illustrated in FIGS. 12*a*–16*a*, a first hydraulic line 402 extends to a suitable source (not illustrated) of hydraulic fluid under pressure at the surface as will be evident to a skilled artisan and is secured within one end of bore 306 through specialty connector 304 by any suitable means, such as by a threaded ferule 403. Another hydraulic line 404 has one end thereof connected to connected to bore 365 in spigot 364 of perforating gun assembly 320*a* while the other end thereof is connected to one end of bore 306 through specialty connector 304 by any suitable means, such as by a threaded ferules 405 and 406, respectively. Still another hydraulic line 407 has one end thereof connected to connected to one end of bore 328 in plug 327 of perforating gun assembly 320*a* while the other end thereof is connected to the threaded end of port 389 in body section 383 of flapper valve subassembly 380 by any suitable means, such as by a threaded ferules 408 and 409, respectively.

Figure 11A:
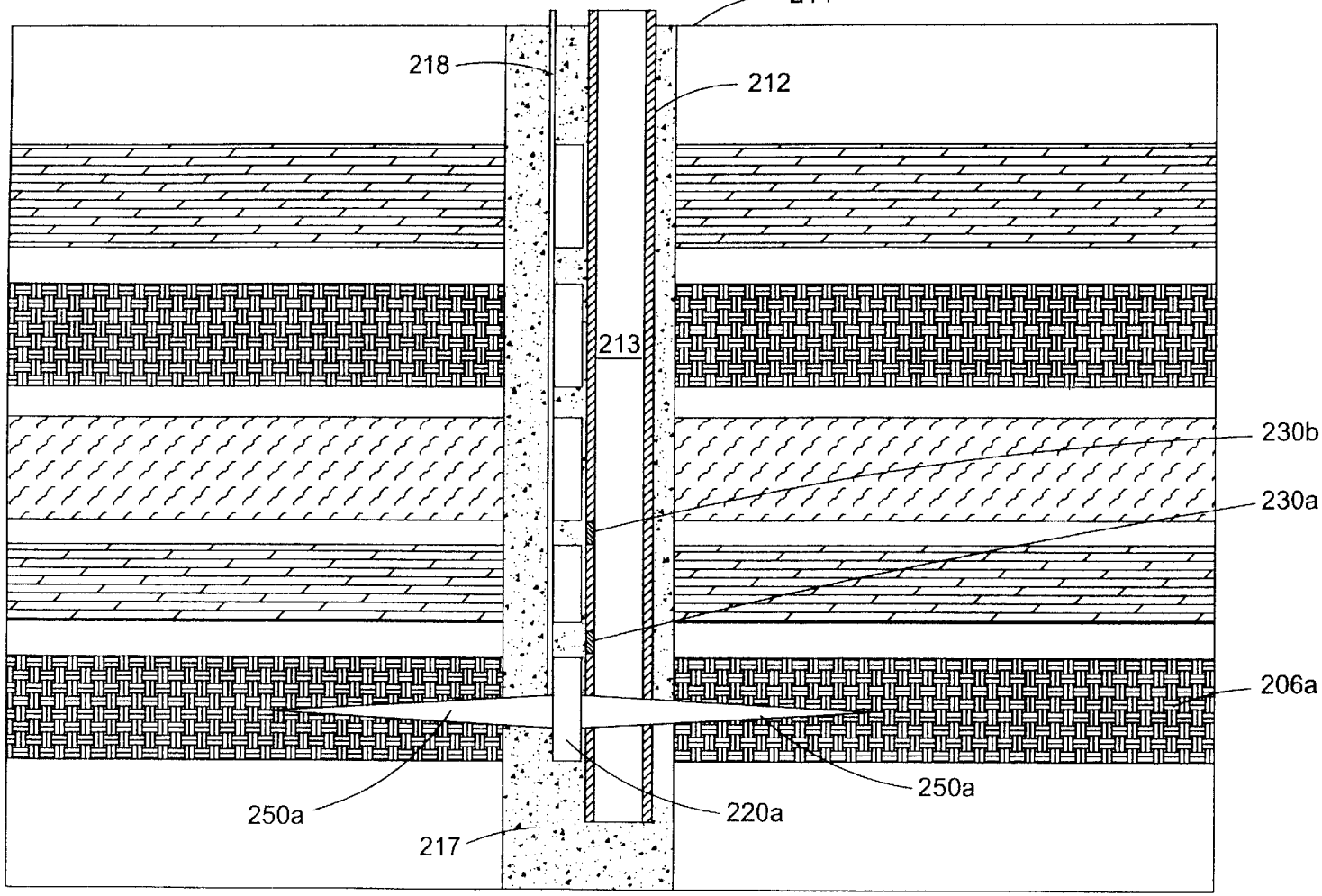
FIGS. 11*a–f* are partially cut away, schematic views of another embodiment of the present invention which is utilized to stimulate and/or treat multiple subterranean formations wherein a zone isolation device is positioned between perforating gun assemblies.
Figure 11B:
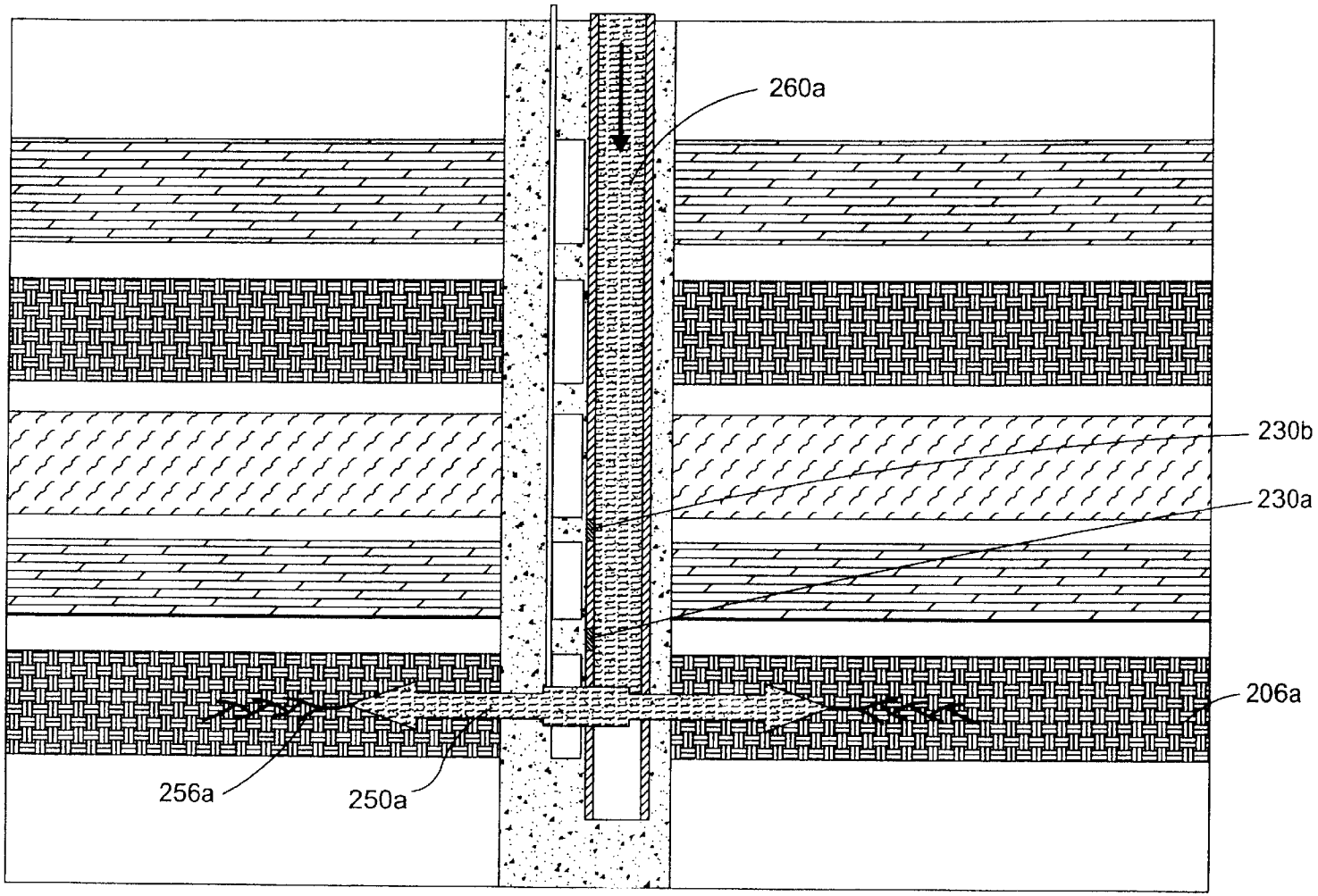
Figure 11C:
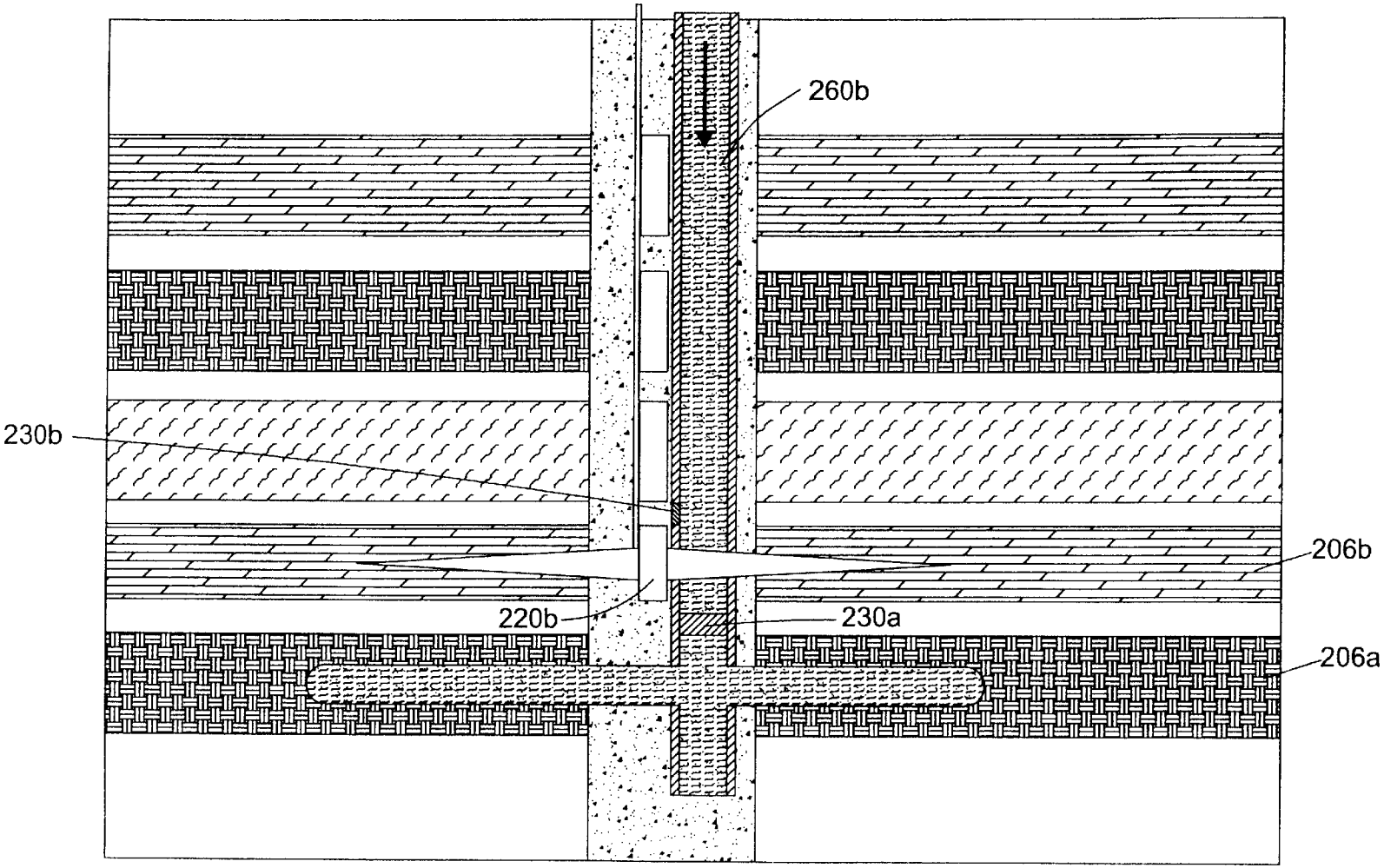
Figure 11D:
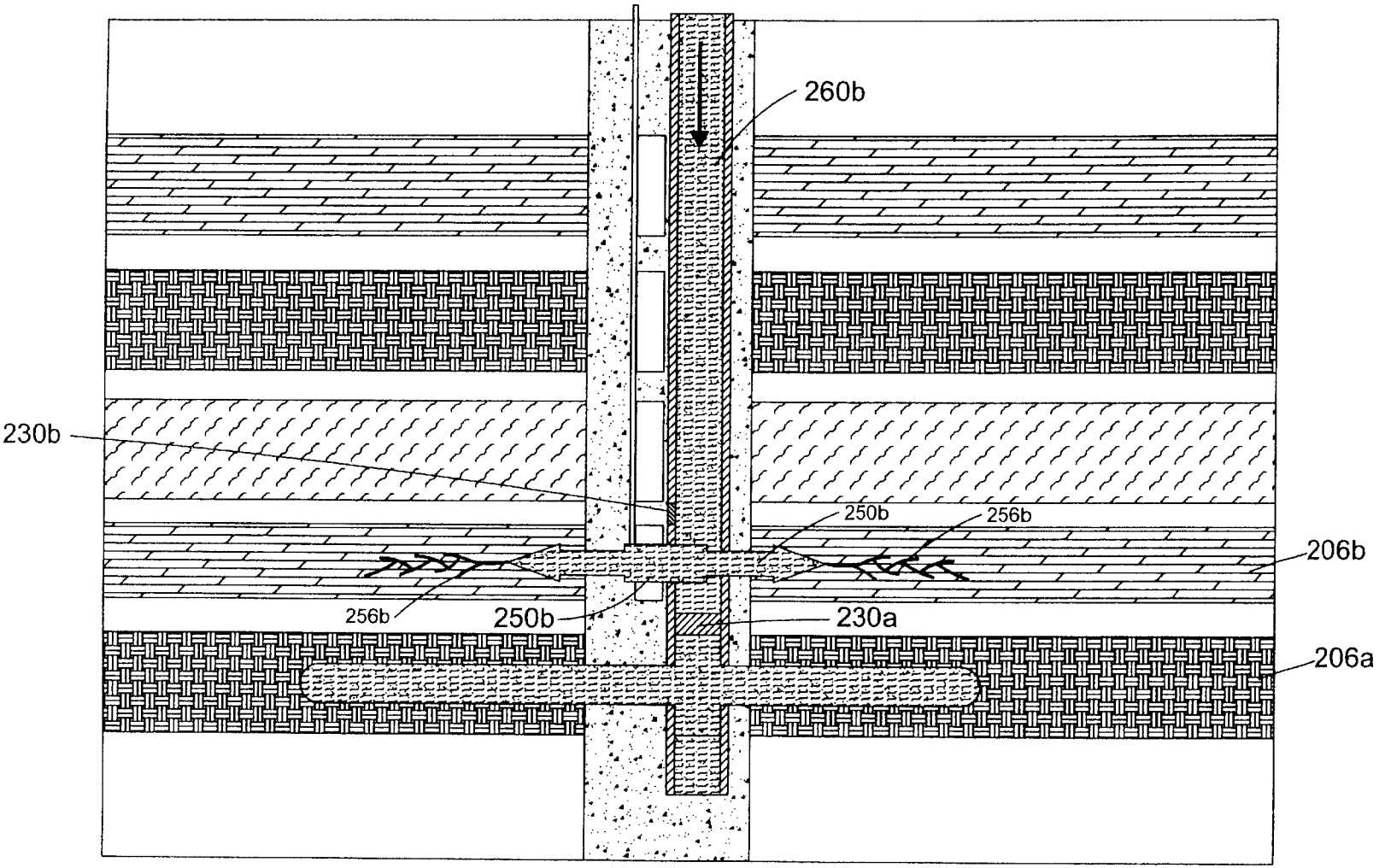
Figure 11E:
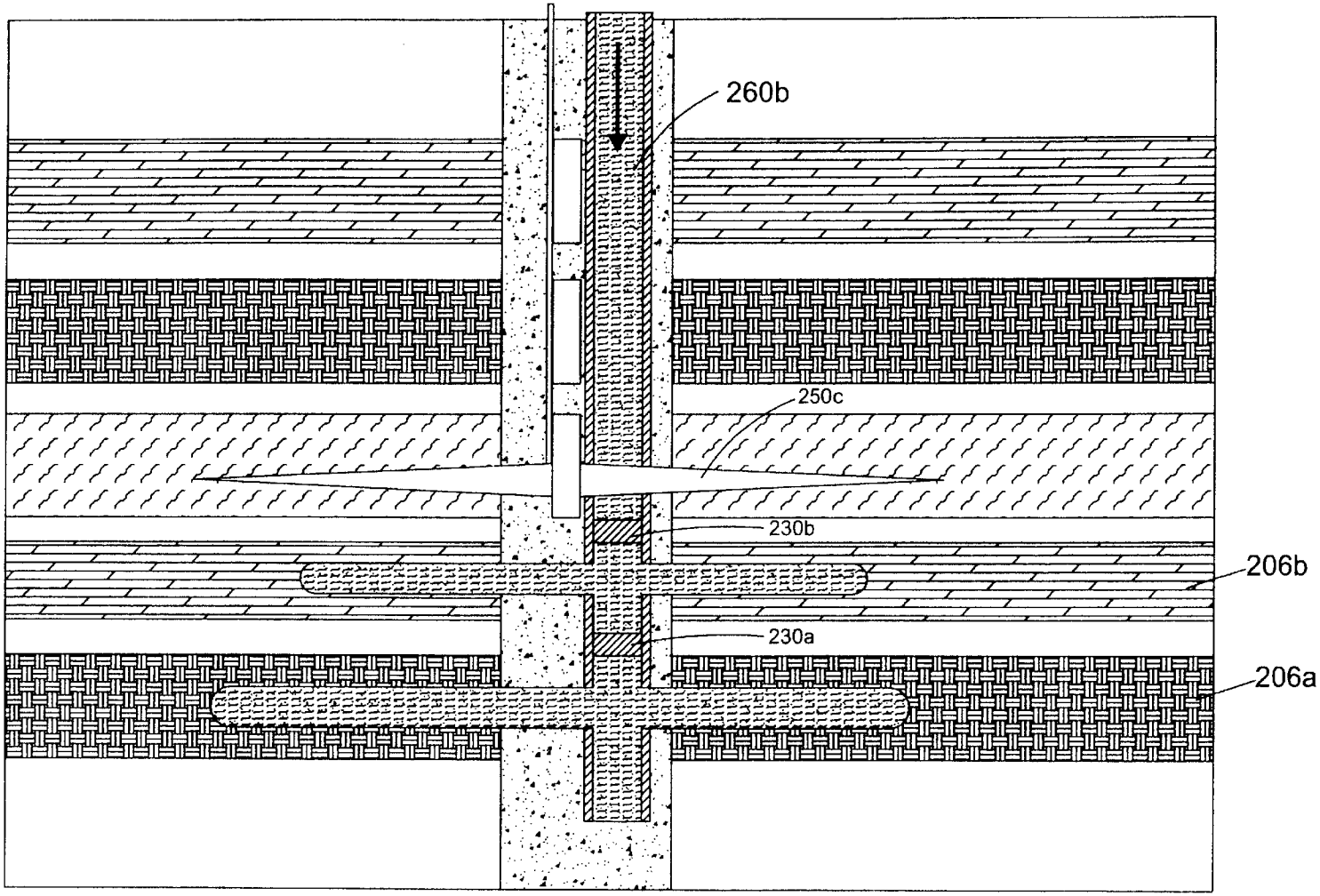
Figure 11F:
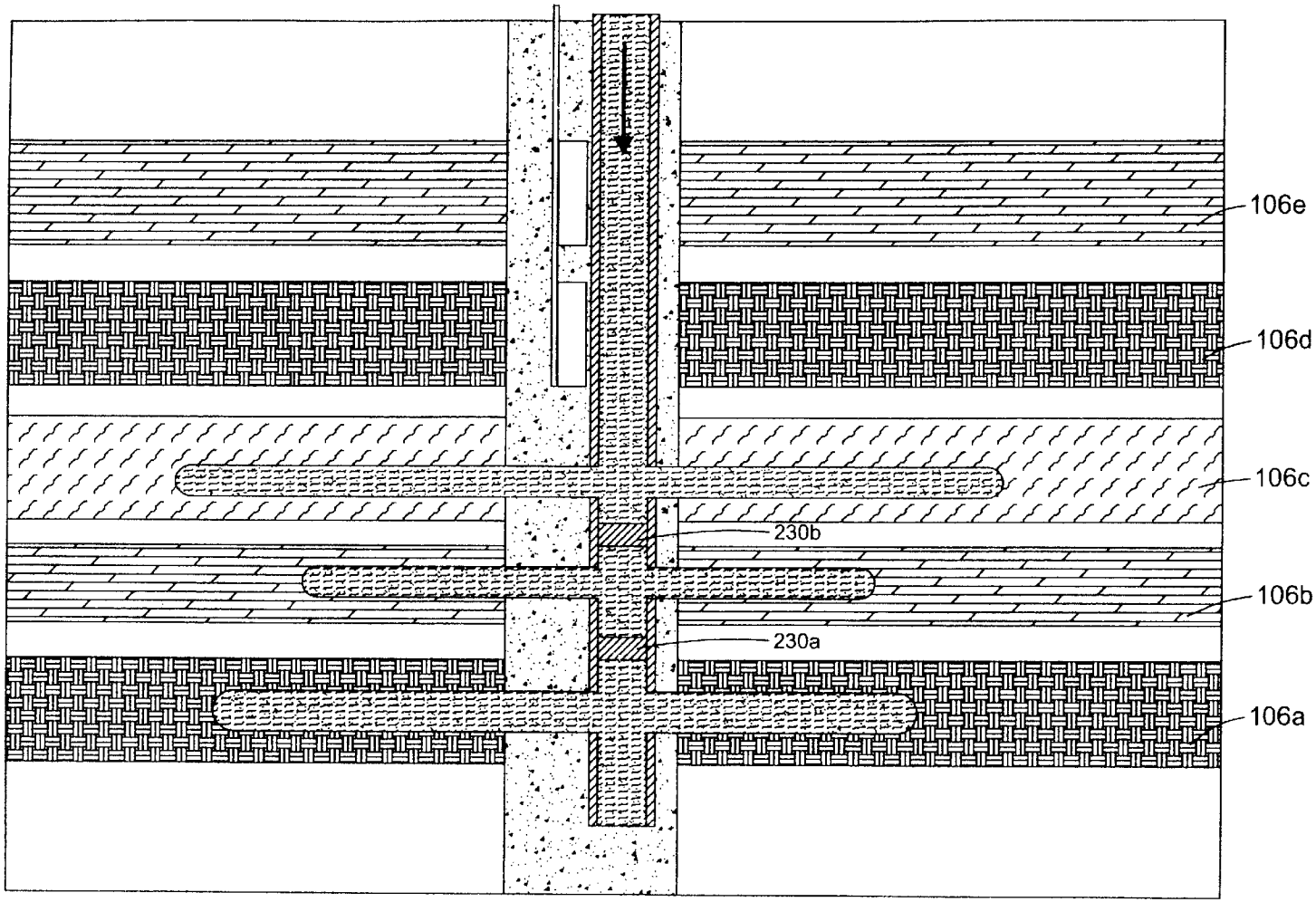
Figure 18:
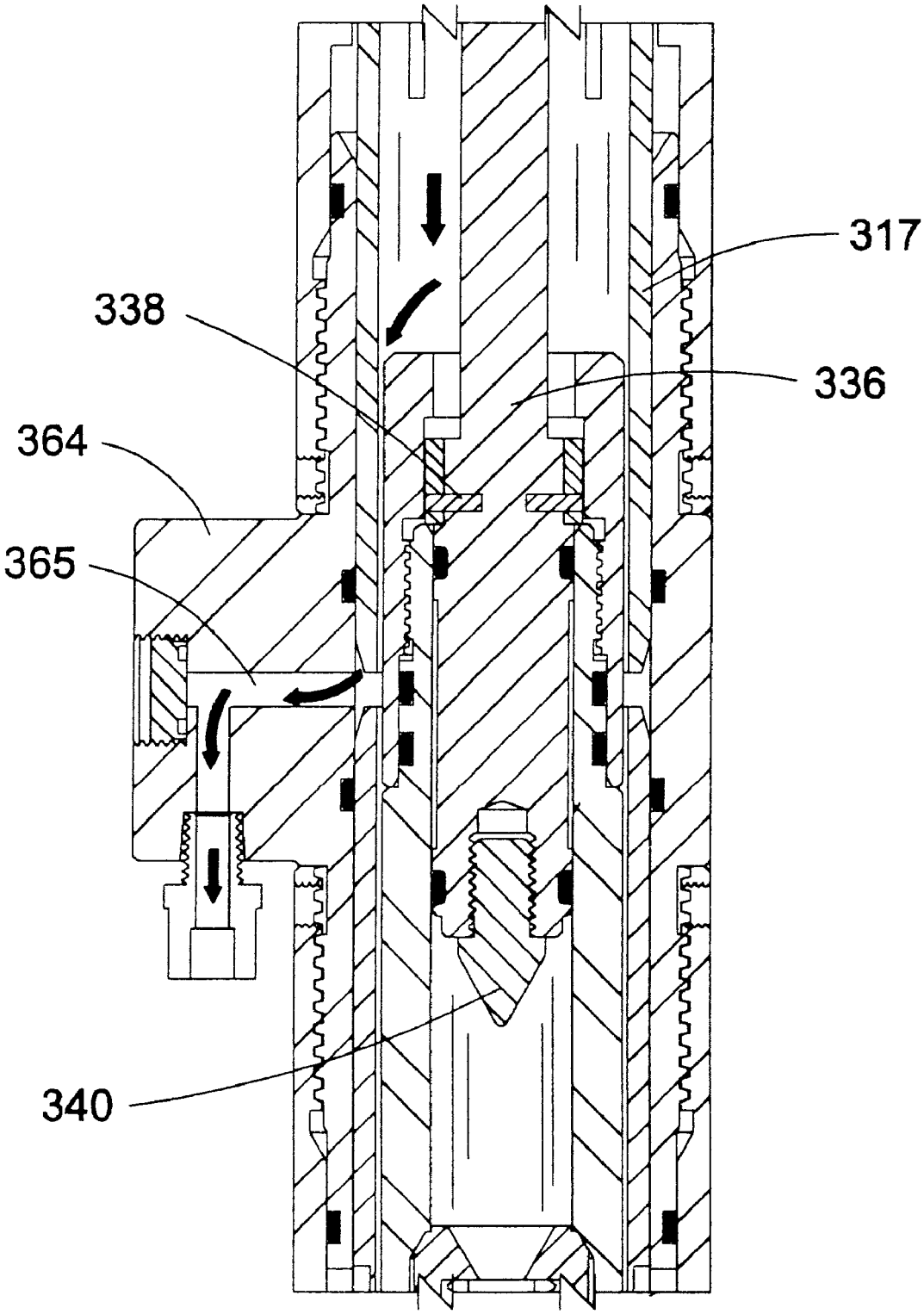
FIG. 18 is a sectional view of a portion of one of the perforating gun assemblies which is illustrated in FIGS. 12*a* and 12*b;*

In operation, the embodiment of the assembly of the present illustrated in FIGS. 12*a*–16*a* is positioned in a subterranean well bore such that perforating gun assemblies are adjacent subterranean formations of interest 206*a* and 206*b* (FIG. 11*a*). Hydraulic fluid is then transported under pressure from a suitable source via hydraulic line 402 to the internal bore through perforating gun assembly 320*a* where, as illustrated in greater detail in FIG. 18, the hydraulic fluid is diverted through bore 365 in spigot 364 and into hydraulic line 404 and perforating gun assembly 320 where the pressure exerted by the hydraulic fluid causes shear pins 338 to shear and firing pin 340 to strike firing head 342 and igniting percussion detonator 343. The ignition of percussion detonator 343 causes a secondary detonation in ignition transfer 345, which in turn ignites detonating cord 349. Detonating cord 349 comprises an explosive and runs between the ends of each charge carrier, passing between the backs of the charges and the charge clips holding the charges in the carrier. Cord 349 ignites the charges 356 in charge carrier 352 and booster transfers, which contains a higher grade explosive than detonating cord 349. Detonation of charges 356 in perforating gun assembly 320 forms perforation(s) 250*a* through casing 212 (FIG. 16*b*), i.e. perforations 311 through casing 310 (FIGS. 16*b* and 16*c*), and cement 217 into formation 206*a* in a manner as previously described with respect to the embodiments illustrated in FIG. 11*a* above. Thereafter, stimulation fluids 260*a*, such as fracturing fluid containing proppants and/or acids, and/or treatment fluids, for example scale inhibitors and/or gelation solutions, are pumped from surface 204 through the interior 213 of casing 212 and into perforations 250*a* (FIG. 11*b*). Radioactive tracers may be incorporated into the stimulation and/or treatment fluids to ensure proper placement of fluids and/or solids contained therein. In the case of fracturing fluids, fractures 256*a* are formed and propagated within formation 206*a*. Where stimulation fluids, such as acidizing fluids, and/or treatment fluids are employed, these fluids need not be pumped at pressures sufficient to create fractures 256*a*.

Figure 13C:
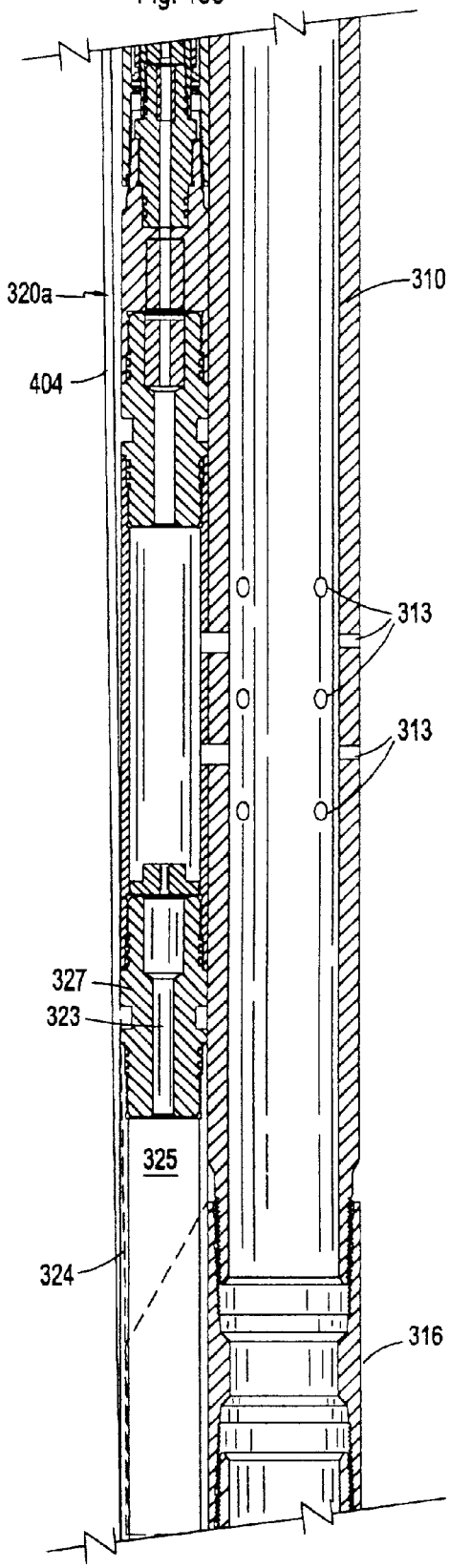
Figure 15C:
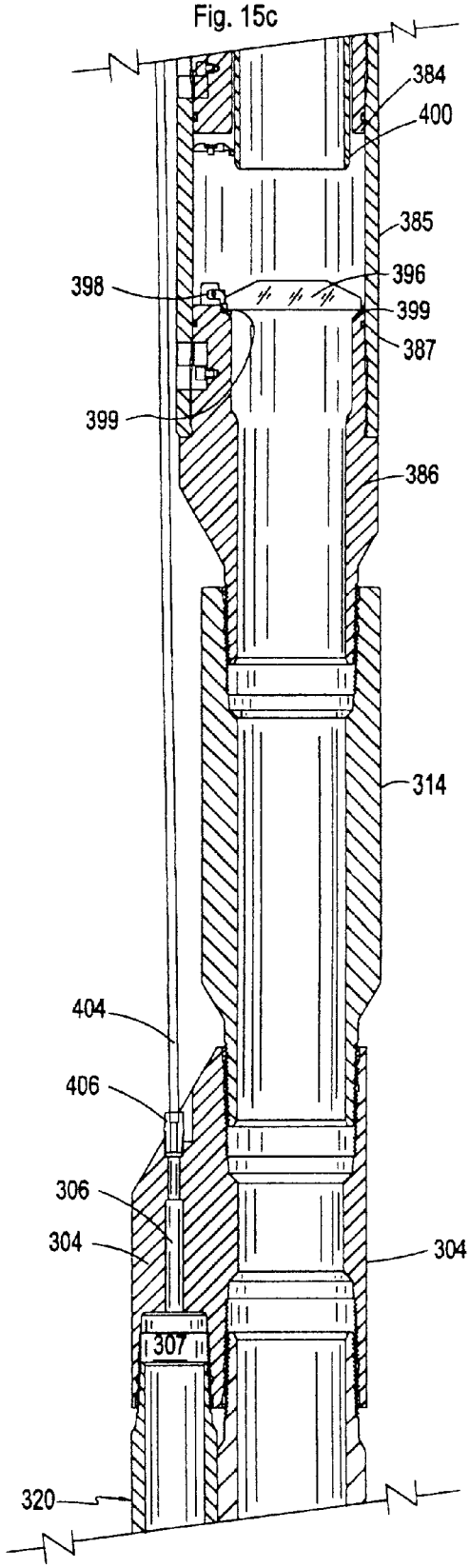
Figure 19:
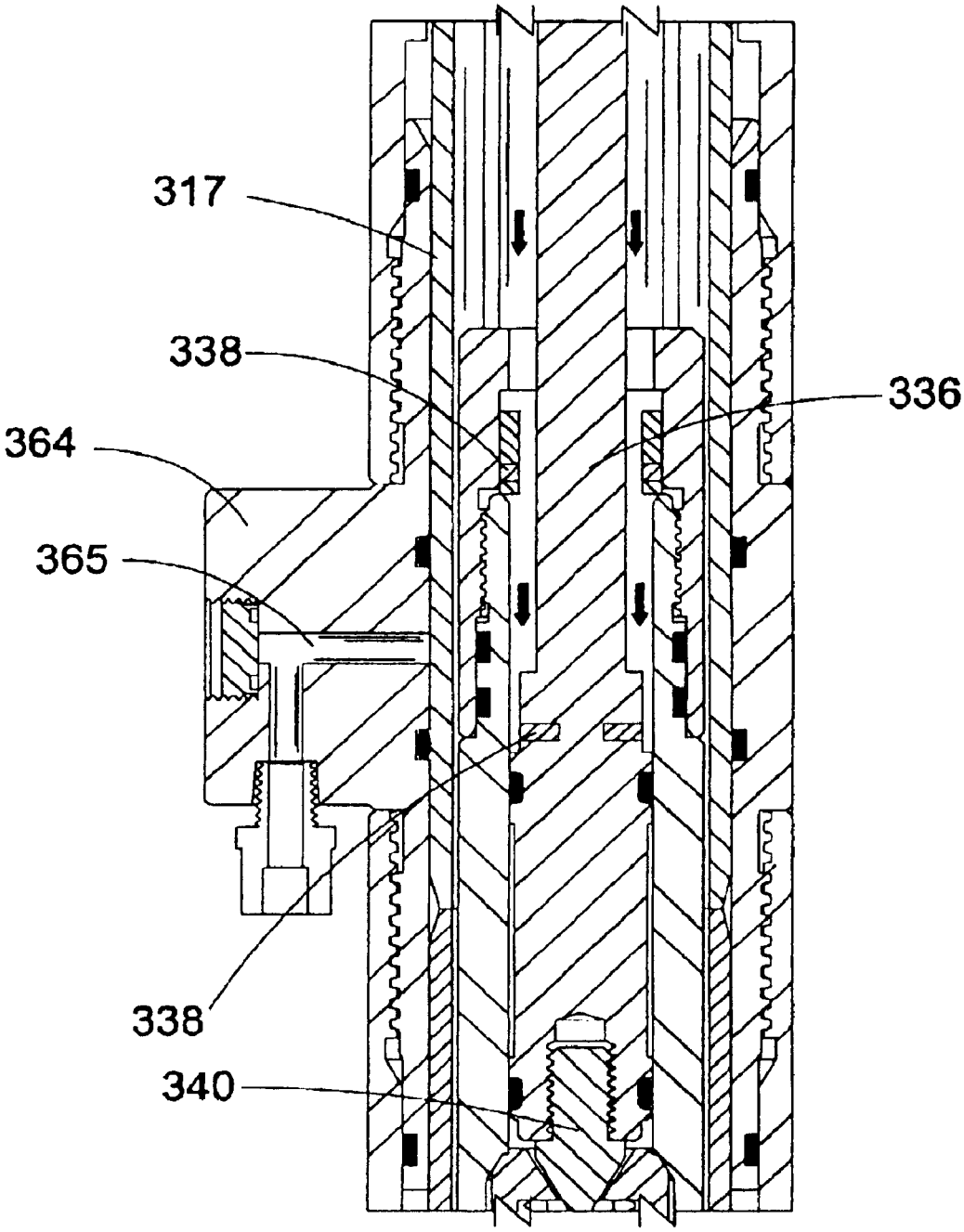
FIG. 19 is a sectional view of a portion of one of the perforating gun assemblies which is illustrated in FIG. 12*c*.

When the stimulation and/or treatment process is completed, hydraulic pressure is increased in line 402 until shear pins 338 in perforating gun assembly 320*a* shear. At this point, piston 336 in perforating gun assembly is free to move which caused pin 315 to contact causing sleeve 317 in perforating gun assembly 320*a* to shift (FIG. 19) thereby sealing bore 365 in spigot 364 against fluid flow. Movement of piston 336 also causes firing pin 340 to strike firing head 342 thereby igniting percussion detonator 343, detonating cord 349 and charges 356 (FIG. 13*c*) in charge carrier 352 forming perforation(s) 260*b* (FIG. 11*c*), i.e. perforations 313 through casing 310 (FIG. 13*c*). The pressure from fluid in the interior of casing 310 is communicated to the interior 325 of housing 324 thereby forcing piston 326 in assembly 320*a* to flow hydraulic fluid to flow through line 407, port 389 and act against shoulder 406 of sleeve 400. In response, sleeve 400 moves until shoulder 404 abuts the end of chamber 395 thereby permitting flapper valve 396 to rotate into engagement with seat 399 (FIG. 15*c*). In this manner, flapper valve 380 seals the interior of casing 310 (212 in FIG. 11*b*) against fluid flow. Thereafter, stimulation fluids 260*b*, such as fracturing fluid containing proppants and/or acids, and/or treatment fluids, for example scale inhibitors and/or gelation solutions, are pumped from surface 204 through the interior 213 of casing 212 (310) and into perforations 250*b* (FIG. 11*d*), i.e. perforations 313 (FIG. 13*c*). Upon completion, zone isolation devices 230*a* and 230*b* may be actuated into an open position or destructed by any suitable means, such as drilling, to permit flow through the interior 213 of casing 212 for fluids produced from and/or injected into formations 206*a*, 206*b* and/or 206*c*.

While the embodiment of the assembly of the present invention which is illustrated in FIGS. 12*a*–16*a* as having two perforating assemblies 320 and 320*a* for completion of two subterranean formations, it will be evident to a skilled artisan that the assembly of this embodiment may be applied to three or more subterranean formations by repeating the portion of assembly 300 denoted as 301 in FIGS. 12A–16A. Proper spacing between perforating gun assemblies 320 and 320*a* or repetitive assemblies 320*a* for treatment of multiple subterranean formations is achieved by varying the lengths of first and/or second lengths of casing 310 as will be evident to a skilled artisan.

The following example demonstrates the practice and utility of the present invention, but is not to be construed as limiting the scope thereof.

EXAMPLE

A well is drilled with a 7.875" bit to 4,000 feet with 11 lb./gal drilling mud and 9.625" surface casing is set at 500 feet. Open hole logs are run and analyzed, along with other information such as geologic offset data, drilling data, and mud logs. It is determined three potential oil productive intervals exist in the well. A carbonate formation is located from 3,700 feet to 3,715 feet and is believed to have low productivity unless stimulated. A sandstone formation is located from 3,600 feet to 3,610 feet and is believed to have low productivity unless stimulated. A highly fractured carbonate in located from 3,500 feet to 3,510 and is believed to not require any stimulation. All of the above depths are based upon open hole logs. An embodiment of the assembly of the present invention is run with 3.5" outside diameter casing and cement float equipment located on the end of the casing. The assembly also contains three externally mounted 2.375" outside diameter perforating guns oriented to shoot into both the casing and the formation, all loaded with 6 shaped charges per foot. Perforating Assembly A contains 15 feet of perforating shaped charges, while Perforating Assemblies B and C contain 10 feet of perforating shaped charges. A flapper valve with the flapper made of ceramic, Assembly D, is also utilized. Approximately 100 feet of casing, with the cement float equipment extends below the connector to Perforating Assembly A. The equipment is positioned utilizing specialty connectors on the 3.5" casing and spacer pipe, and utilizing the top perforating charge in Assembly A as a reference point such that flapper valve Assembly D is 80 feet in distance from the reference point, the top of Perforating Assembly B is 100 feet in distance from the reference point, and Perforating Assembly C is 200 feet in distance from the reference point. Hydraulic control line is connected to all of appropriate assemblies and run into the borehole with the additional lengths of 3.5" casing required to comprise the complete casing string by placing steel bands around the control line and the casing every 30 feet up the wellbore.

The casing string is run into the wellbore until pipe measurements suggest the top of Perforating Assembly A is located at 3,700 feet pipe measurement. The well is circulated with drilling muds and a gamma ray casing collar log is run to determine the relative position of the Perforating Assembly A to open hole logging depths. Based upon correlations, it is determined the equipment and casing needs to be lowered into the wellbore an additional 5 feet to be exactly on depth and the logging tool is removed from the well. The pipe is lowered into the wellbore a total of 6 feet, as engineering calculations suggest casing movement will contract the string approximately one foot during cementing operations. The casing is landed on the wellhead equipment and cemented into the open hole by pumping 15.8 lb./gal. cement in sufficient quantity to fill the entire annulus, and the cement is displaced with a 9.0 lb/gal brine to the cement float equipment.

At some later date in time, when the cement has cured, Perforating Assembly A is detonated by connecting on surface to the hydraulic control line that is cemented outside of the casing and applying 1500 psi surface pressure to actuate the pressure actuated firing head. It may be desired to attempt to allow this interval to flow into the interior of the casing and up the casing to surface to obtain preliminary reservoir information. This lowermost interval of the well is then acid stimulated by pumping 10,000 gallons of 15% hydrochloric acid at 3,500 psi at 5 barrels per minute injection rate. The acid is displaced with the first stage of a fracturing fluid which will be utilized to stimulate the second interval, from 3,600 feet to 3,610 feet. Displacement of the acid is ceased while the last portion of the acid remains located from the lowermost perforations (3,700 feet to 3,715 feet) to 3,300 feet. Perforating Assembly B is immediately detonated by applying 2,500 psi surface pressure to actuate this pressure actuated firing head. This perforating event allows interior casing hydrostatic pressure to enter the interior of Perforating Assembly B and transfer down the secondary line to actuate and close flapper valve Assembly D. This interval is also perforated with acid across from the perforations, which can aid in dissolving crushed cement from the perforating event. A sand laden hydraulic fracture stimulation (30,000 pounds of sand in 12,000 gallons of fracturing fluids) is subsequently pumped into this middle interval of the well and displaced to the perforations with brine. Perforating Assembly C is subsequently detonated by applying 3,500 psi surface pressure to actuate this pressure actuated firing head. All three intervals are produced together up the casing to surface. At a later date it is determined by wireline work down the interior of the casing that no sand is lodged on top of the flapper valve Assembly D. Flow to surface is ceased and a 1" diameter bar by 10 feet in length is dropped and breaks the flapper valve into fragments. The well is then returned to production.

The process and assembly of the present invention may also involve the use of propellant material in conjunction with the perforating gun assembly to substantially simultaneously enhance the effectiveness of the resulting perforations and to stimulate the subterranean formation(s). In accordance with this embodiment, propellant in the form of a sleeve, strip, patch or any other configuration is outside of the perforating assembly and casing and in the path in which at least one of the explosive charges in at least one perforating assembly which is utilized in the process of the present invention is aimed. The propellant material may be positioned on either one or more perforating assembly 20, 120, 220 or 350 or casing 12, 112, 212 or 310, respectively. Upon detonation of an explosive charge in a perforating assembly, propellant material which is positioned in the path in which the explosive charge is aimed breaks apart and ignites due to the shock, heat, and pressure of the detonated explosive charge. When one or more explosive charges penetrate a subterranean formation, pressurized gas generated from the burning of the propellant material enters the formation through the recently formed perforations thereby cleaning such perforations of debris. These propellant gases also stimulate the formation by extending the connectivity of formation with the well bore by means of the pressure of the propellant gases fracturing the formation. Additionally or alternatively, the carrier of perforating assembly, e.g. charge carrier 352, may be constructed of propellant material which ignites upon detonation of the explosive charge. Disintegration of the carrier upon ignition may assist the connectivity between perforations formed via perforating gun assemblies having multiple explosive charges. Preferably, the propellant material is a cured epoxy, carbon fiber composite having an oxidizer incorporated therein such as that commercially available from HTH Technical Services, Inc. of Coeur d'Alene, Id.

In addition to the equipment, such as a gamma ray logging tool mentioned above, the assembly of the present invention may also include other equipment, for example temperature and pressure gauges, which are positioned on the exterior of the casing of the assembly and connected to the signal device 18, if necessary to power the equipment. The use of a gamma ray logging tool, pressure gauge and temperature gauge can provide invaluable real time information to enable a skilled artisan to monitor fracture growth where the subterranean formation(s) are fracture using the processes and assembly of the present invention.

While the foregoing preferred embodiments of the invention have been described and shown, it is understood that the alternatives and modifications, such as those suggested and others, may be made thereto and fall within the scope of the invention.

We claim:

1. A method of completing a well comprising:

transmitting at least one acoustic wave via the earth from the surface of the earth to equipment that is positioned in a subterranean well bore outside of casing.

2. A method of completing a well comprising:

transmitting at least one electromagnetic wave via the earth from the surface of the earth to equipment that is positioned in a subterranean well bore outside of casing.

3. A method of completing a well comprising:

transmitting at least one wave via the earth from the surface of the earth to a perforating gun assembly that is positioned in a subterranean well bore outside of casing, wherein the step of transmitting provides an appropriate signal to ignite at least one explosive charge contained in said perforating gun assembly and perforate said casing.

4. The method of claim 3 wherein said wave is acoustic.

5. The method of claim 3 wherein said wave is electromagnetic.

* * * * *